US011472650B2

(12) United States Patent
Niwata et al.

(10) Patent No.: US 11,472,650 B2
(45) Date of Patent: Oct. 18, 2022

(54) MEDIUM CONVEYING APPARATUS FOR CONTROLLING FEEDING BASED ON A MOVEMENT AMOUNT OF AN ARM AND A SIZE OF A MEDIUM

(71) Applicant: PFU LIMITED, Kahoku (JP)

(72) Inventors: Tomoyuki Niwata, Kahoku (JP); Ken Funaki, Kahoku (JP); Hiroyuki Kitano, Kahoku (JP)

(73) Assignee: PFU LIMITED, Kahoku (JP)

( * ) Notice: Subject to any disclaimer, the term of this patent is extended or adjusted under 35 U.S.C. 154(b) by 22 days.

(21) Appl. No.: 17/083,122

(22) Filed: Oct. 28, 2020

(65) Prior Publication Data

US 2021/0188581 A1 Jun. 24, 2021

(30) Foreign Application Priority Data

Dec. 19, 2019 (JP) ..... JP2019-229531

(51) Int. Cl.
*B65H 7/18* (2006.01)
*B65H 3/06* (2006.01)
(Continued)

(52) U.S. Cl.
CPC ..... *B65H 7/18* (2013.01); *B65H 3/063* (2013.01); *B65H 3/0661* (2013.01);
(Continued)

(58) Field of Classification Search
CPC ..... B65H 3/06; B65H 3/063; B65H 3/0661; B65H 3/68; B65H 7/00; B65H 7/02; B65H 7/06; B65H 7/12; B65H 7/125; B65H 7/14; B65H 7/18; B65H 2405/11152; B65H 2511/152; B65H 2511/11; B65H 2511/15; B65H 2511/52
See application file for complete search history.

(56) References Cited

U.S. PATENT DOCUMENTS 4,674,736 A * 6/1987 Tsubo ..... B65H 3/5261 271/146
2015/0336759 A1* 11/2015 Tsuyuki ..... B65H 3/0684 271/265.02

(Continued)

FOREIGN PATENT DOCUMENTS

JP 2017-218296 A 12/2017

*Primary Examiner* — Prasad V Gokhale
(74) *Attorney, Agent, or Firm* — Lewis Roca Rothgerber Christie LLP

(57) ABSTRACT

A medium conveying apparatus includes a medium tray, a feed roller, an upper guide, a movement sensor including an arm movably provided by the fed medium on the upper guide and on an upstream side of the feed roller, to generate a movement amount signal corresponding to a movement amount of the arm, a medium sensor to detect a presence of the medium at a predetermined position of the medium tray, a processor to determine whether a feeding abnormality of the medium has occurred based on the movement amount signal, detect a size of the medium placed on the medium tray based on a detection result by the medium sensor, and stop feeding of the medium by the feed roller when the processor determines that the feeding abnormality of the media has occurred and the detected size of the media is equal to or less than a predetermined size.

15 Claims, 16 Drawing Sheets

(51) Int. Cl.

| | |
|---|---|
| ***B65H 7/14*** | (2006.01) |
| ***B65H 7/06*** | (2006.01) |
| ***B65H 3/68*** | (2006.01) |
| *B41J 13/02* | (2006.01) |

(52) U.S. Cl.
CPC ..... *B65H 3/0669* (2013.01); *B65H 3/68* (2013.01); *B65H 7/06* (2013.01); *B65H 7/14* (2013.01); *B41J 13/02* (2013.01); *B65H 2511/52* (2013.01)

(56) References Cited

U.S. PATENT DOCUMENTS

| | | | | |
|---|---|---|---|---|
| 2017/0355539 | A1* | 12/2017 | Yoshiwara ..... | H04N 1/00777 |
| 2019/0193970 | A1* | 6/2019 | Yamaguchi ..... | B65H 1/14 |
| 2020/0198908 | A1* | 6/2020 | Shimosaka ..... | B65H 3/0661 |
| 2021/0107754 | A1* | 4/2021 | Fujii ..... | B65H 3/5261 |

* cited by examiner

MEDIUM CONVEYING APPARATUS FOR CONTROLLING FEEDING BASED ON A MOVEMENT AMOUNT OF AN ARM AND A SIZE OF A MEDIUM

CROSS-REFERENCE TO RELATED APPLICATIONS

This application is based upon and claims the benefit of priority of prior Japanese Patent Application No. 2019-229531, filed on Dec. 19, 2019, the entire contents of which are incorporated herein by reference.

TECHNICAL FIELD

Embodiments discussed in the present specification relate to medium feeding.

BACKGROUND

Recently, a medium conveying apparatus such as a scanner is required to convey not only a paper but also a booklet such as a passport or a passbook, as a medium. The medium conveying apparatus that supports the conveyance of such a kind of medium, has a separation mode in which the medium is separated and fed and a non-separation mode in which the medium is fed without being separated. However, when the booklet is fed by mistake in the separation mode, a feeding abnormality such as a jam (paper jam) may occur. The conveying apparatus needs to stop the feeding of the medium so as not to damage the medium when the feeding abnormality such as the jam occurs.

A conveying apparatus including separating means for conveying a sheet one by one separated, and a movable member displaced by a deformation of the sheet passing through the separating means, to detect the deformation of the sheet in accordance with a displacement of the movable member, is disclosed (Japanese Unexamined Patent Publication (Kokai) No. 2017-218296). This conveying apparatus stops the conveyance by the separation means when the deformation of the sheet is detected.

SUMMARY

According to some embodiments, a medium conveying apparatus includes a medium tray, a feed roller to feed by separating a medium placed on the medium tray, an upper guide located to face a lower guide to guide the medium to the feed roller, a movement sensor including an arm movably provided by the fed medium on the upper guide and on an upstream side of the feed roller, to generate a movement amount signal corresponding to a movement amount of the arm, a medium sensor to detect a presence of the medium at a predetermined position of the medium tray, a processor to determine whether a feeding abnormality of the medium has occurred based on the movement amount signal, detect a size of the medium placed on the medium tray based on a detection result by the medium sensor, and stop feeding of the medium by the feed roller when the processor determines that the feeding abnormality of the media has occurred and the detected size of the media is equal to or less than a predetermined size.

According to some embodiments, a method for controlling feeding a medium includes feeding by separating a medium placed on a medium tray by a feed roller, generating a movement amount signal corresponding to a movement amount of an arm movably provided by the fed medium on an upper guide located to face a lower guide to guide the medium to the feed roller, and on an upstream side of the feed roller, by a movement sensor, detecting a presence of the medium at a predetermined position of the medium tray by a medium sensor, determining whether a feeding abnormality of the medium has occurred based on the movement amount signal, detecting a size of the medium placed on the medium tray based on a detection result by the medium sensor, and stopping feeding of the medium by the feed roller when it is determined that the feeding abnormality of the media has occurred and the detected size of the media is equal to or less than a predetermined size.

According to some embodiments, a computer-readable, non-transitory medium stores a computer program. The computer program causes a medium conveying apparatus including a medium tray, a feed roller to feed by separating a medium placed on the medium tray, an upper guide located to face a lower guide to guide the medium to the feed roller, a movement sensor including an arm movably provided by the fed medium on the upper guide and on an upstream side of the feed roller, to generate a movement amount signal corresponding to a movement amount of the arm, a medium sensor to detect a presence of the medium at a predetermined position of the medium tray, to execute a process including determining whether a feeding abnormality of the medium has occurred based on the movement amount signal, detecting a size of the medium placed on the medium tray based on a detection result by the medium sensor, and stopping feeding of the medium by the feed roller when it is determined that the feeding abnormality of the media has occurred and the detected size of the media is equal to or less than a predetermined size.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
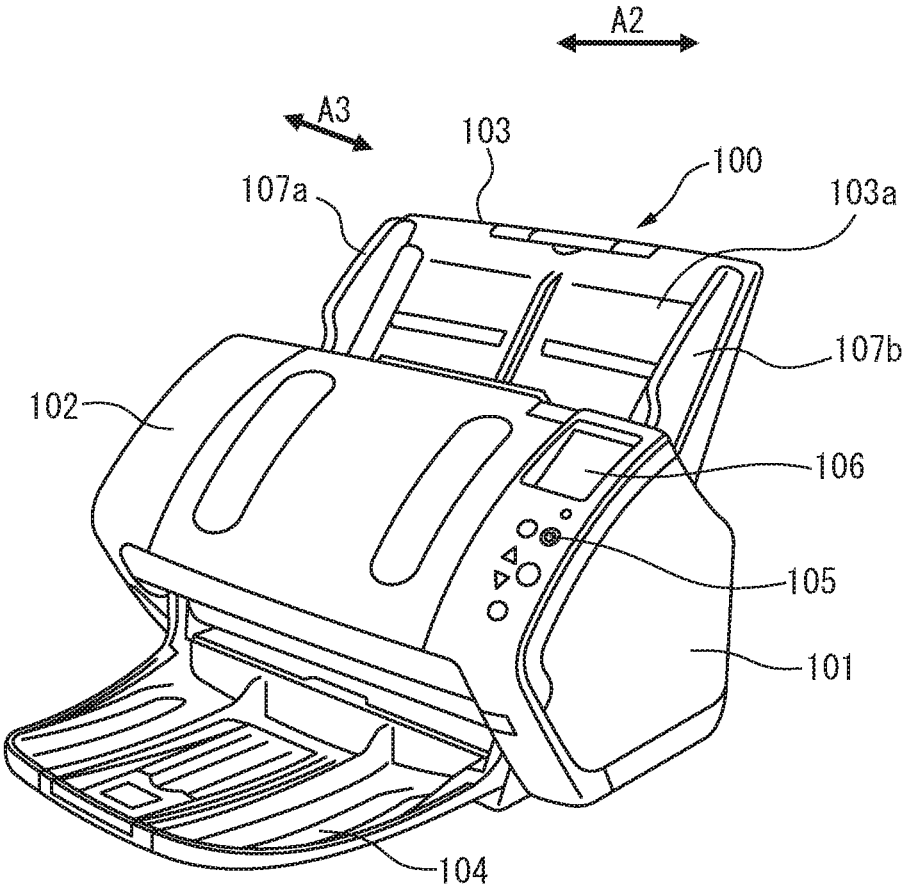
FIG. 1 is a perspective view illustrating a medium conveying apparatus 100 according to an embodiment.

FIG. 1 is a perspective view illustrating a medium conveying apparatus 100 configured as an image scanner. The medium conveying apparatus 100 conveys and images a medium being a document. The medium is a paper, a thick paper, a card, a booklet, etc. A booklet includes a small booklet such as a passport or a passbook. A small booklet is a booklet whose size in a direction along the stitched portion is less than the lateral size (210 mm) of A4. The small booklet may be a booklet whose size in the direction along the stitched portion is equal to or less than the size of the passport (128 mm), or is equal to or less than the size of the passbook (140 mm). The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, an ejection tray 104, an operation device 105, and a display device 106, etc.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc.

The medium tray 103 is engaged with the lower housing 101 in such away as to be able to place a medium to be conveyed. The medium tray 103 has a mounting surface 103*a* on which a medium is placed, and side guides 107*a* and 107*b* are provided on the mounting surface 103*a*. The side guides 107*a*, 107*b* are movably provided in a width direction A2 perpendicular to a medium conveying direction on the medium tray 103, and regulates the width direction of the medium placed on the medium tray 103. Hereinafter, the side guides 107*a* and 107*b* may be collectively referred to as the side guide 107. The ejection tray 104 is engaged with the lower housing 101 in such a way as to be able to hold an ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

Figure 2:
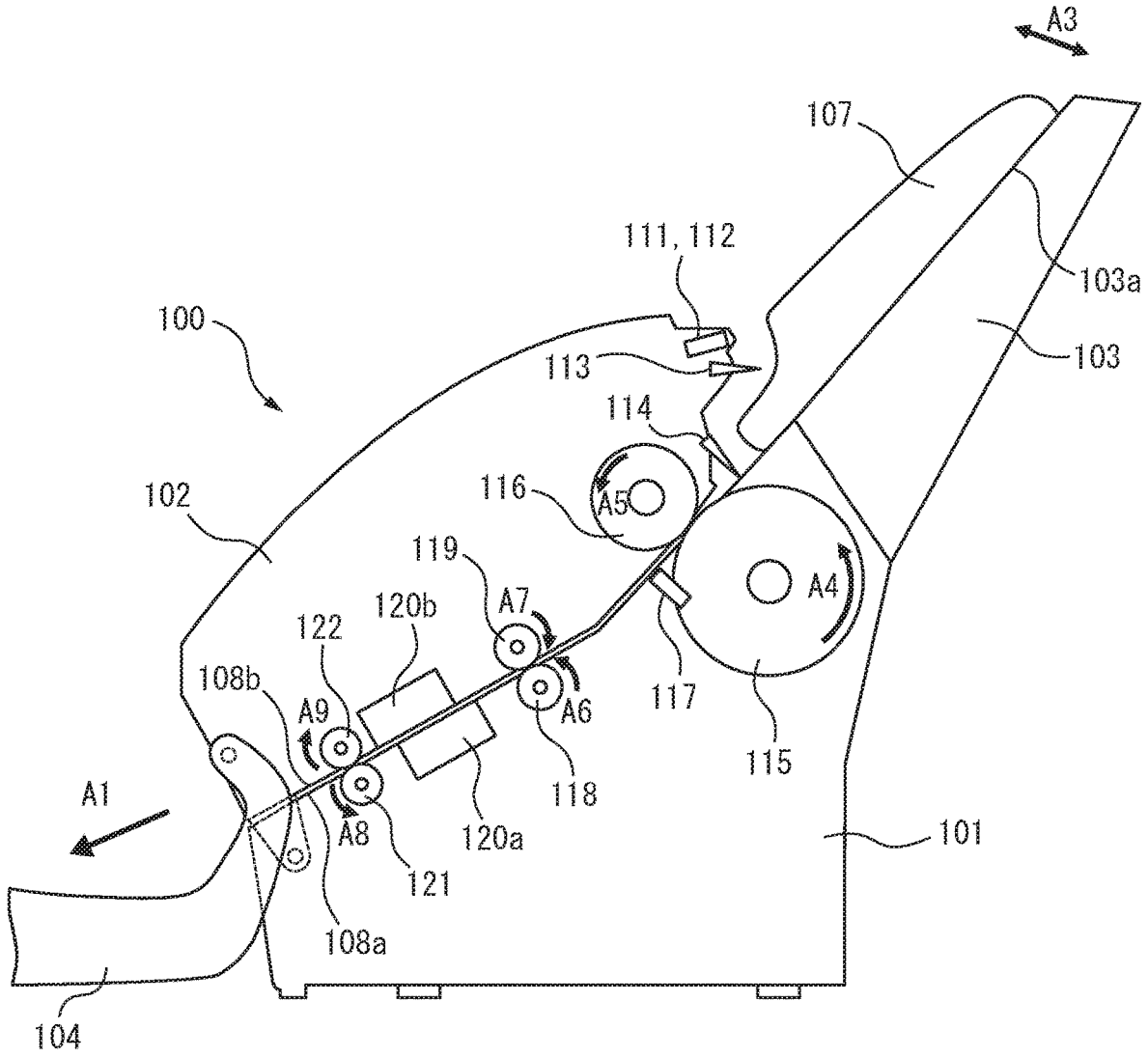
FIG. 2 is a diagram for illustrating a conveyance path inside the medium conveying apparatus 100.

FIG. 2 is a diagram for illustrating a conveyance path inside the medium conveying apparatus 100.

The conveyance path insides the medium conveying apparatus 100, a first sensor 111, a second sensor 112, a movement sensor 113, a third sensor 114, a feed roller 115, a brake roller 116, a fourth sensor 117, a first conveyance roller 118, a second conveyance roller 119, a first imaging device 120*a*, a second imaging device 120*b*, a third conveyance roller 121 and a fourth conveyance roller 122, etc. The numbers of each roller is not limited to one, and may be plural.

The upper surface of the lower housing 101 forms a lower guide 108*a* of the conveyance path of the medium, and guides the medium to the feed roller 115, the brake roller 116, the fourth sensor 117, and the first to fourth conveyance rollers 118, 119, 121, and 122. The lower surface of the upper housing 102 forms an upper guide 108*b* of the conveyance path of the medium. The upper guide 108*b* is located to face the lower guide 108*a*. An arrow A1 in FIG. 2 indicates a medium conveying direction. An upstream hereinafter refers to an upstream in the medium conveying direction A1, and a downstream refers to a downstream in the medium conveying direction A1.

The third sensor 114 is located on the downstream side of the first sensor 111, the second sensor 112 and the movement sensor 113 and on the upstream side of the feed roller 115 and the brake roller 116. The third sensor 114 includes a contact detection sensor and detects whether or not a medium is placed on the medium tray 103. The third sensor 114 generates and outputs a third medium signal whose signal value changes between a state in which a medium is placed on the medium tray 103 and a state in which a medium is not placed.

The feed roller 115 is provided on the lower housing 101 and sequentially feed media placed on the medium tray 103 from the lower side. The brake roller 116 is provided in the upper housing 102 and is located to face the feed roller 115.

The fourth sensor 117 is located on the downstream side of the feed roller 115 and the brake roller 116 and on the upstream side of the first conveyance roller 118 and the second conveyance roller 119. The fourth sensor 117 detects whether or not the medium exists at the position. The fourth sensor 117 includes a light emitter and a light receiver provided on one side with respect to the conveyance path of the medium, and a reflection member such as a mirror provided at a position facing the light emitter and the light receiver with the conveyance path in between. The light emitter emits light toward the conveyance path. On the other hand, the light receiver receives light emitted by the light emitter and reflected by the reflection member and outputs a fourth medium signal which is an electric signal based on intensity of the received light. When the medium exists at the position of the fourth sensor 117, the signal value of the fourth medium signal varies between a state in which the medium exists and a state in which the medium does not exist at the position of the fourth sensor 117 since the light irradiated by the light emitter is shielded by the medium. The light emitter and the light receiver may be provided at positions facing one another with the conveyance path in between, and the reflection member may be omitted.

The first imaging device 120*a* includes a line sensor based on a unity-magnification optical system type contact image sensor (CIS) including an imaging element based on a complementary metal oxide semiconductor (CMOS) linearly located in a main scanning direction. Further, the first imaging device 120*a* includes a lens for forming an image on the imaging element, and an A/D converter for amplifying and analog-digital (A/D) converting an electric signal output from the imaging element. The first imaging device

120*a* generates and outputs an input image acquired by imaging a front surface of a conveyed medium, in accordance with control from a processing circuit to be described later.

Similarly, the second imaging device 120*b* includes a line sensor based on a unity-magnification optical system type CIS including an imaging element based on a CMOS linearly located in a main scanning direction. Further, the second imaging device 120*b* includes a lens for forming an image on the imaging element, and an A/D converter for amplifying and A/D converting an electric signal output from the imaging element. The second imaging device 120*b* generates and outputs an input image acquired by imaging a back surface of a conveyed medium, in accordance with control from a processing circuit to be described later.

Only either of the first imaging device 120*a* and the second imaging device 120*b* may be located in the medium conveying apparatus 100 and only one side of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs. Hereinafter, the first imaging device 120*a* and the second imaging device 120*b* may be collectively referred to as an imaging device 120.

The medium placed on the medium tray 103 is conveyed in the medium conveying direction A1 between the lower guide 108*a* and the upper guide 108*b* by rotating the feed roller 115 in the direction of the arrow A4 in FIG. 2. The brake roller 116 rotates in the direction of the arrow A5 when the medium is conveyed. By the workings of the feed roller 115 and the brake roller 116, when a plurality of media are placed on the medium tray 103, only a medium in contact with the feed roller 115, out of the media placed on the medium tray 103, is separated. Consequently, the medium conveying apparatus 100 operates in such a way that conveyance of a medium other than the separated medium is restricted (prevention of multi-feed). The feed roller 115 and the brake roller 116 is an example of a feeding unit to feed by separating the medium placed on the medium tray 103.

The medium is fed between the first conveyance roller 118 and the second conveyance roller 119 while being guided by the lower guide 108*a* and the upper guide 108*b*. The medium is fed between the first imaging device 120*a* and the second imaging device 120*b* by the first conveyance roller 118 and the second conveyance roller 119 rotating in the directions of the directions of arrow A6 and A7, respectively. The first conveyance roller 118 and the second conveyance roller 119 are examples of a conveyance roller to convey the medium fed by the feed roller 115 to the imaging device 120. The medium read by the imaging devices 120 is ejected on the ejection tray 104 by the third conveyance roller 121 and the fourth conveyance roller 122 rotating in directions of an arrow A8 and an arrow A9, respectively.

Figure 3:
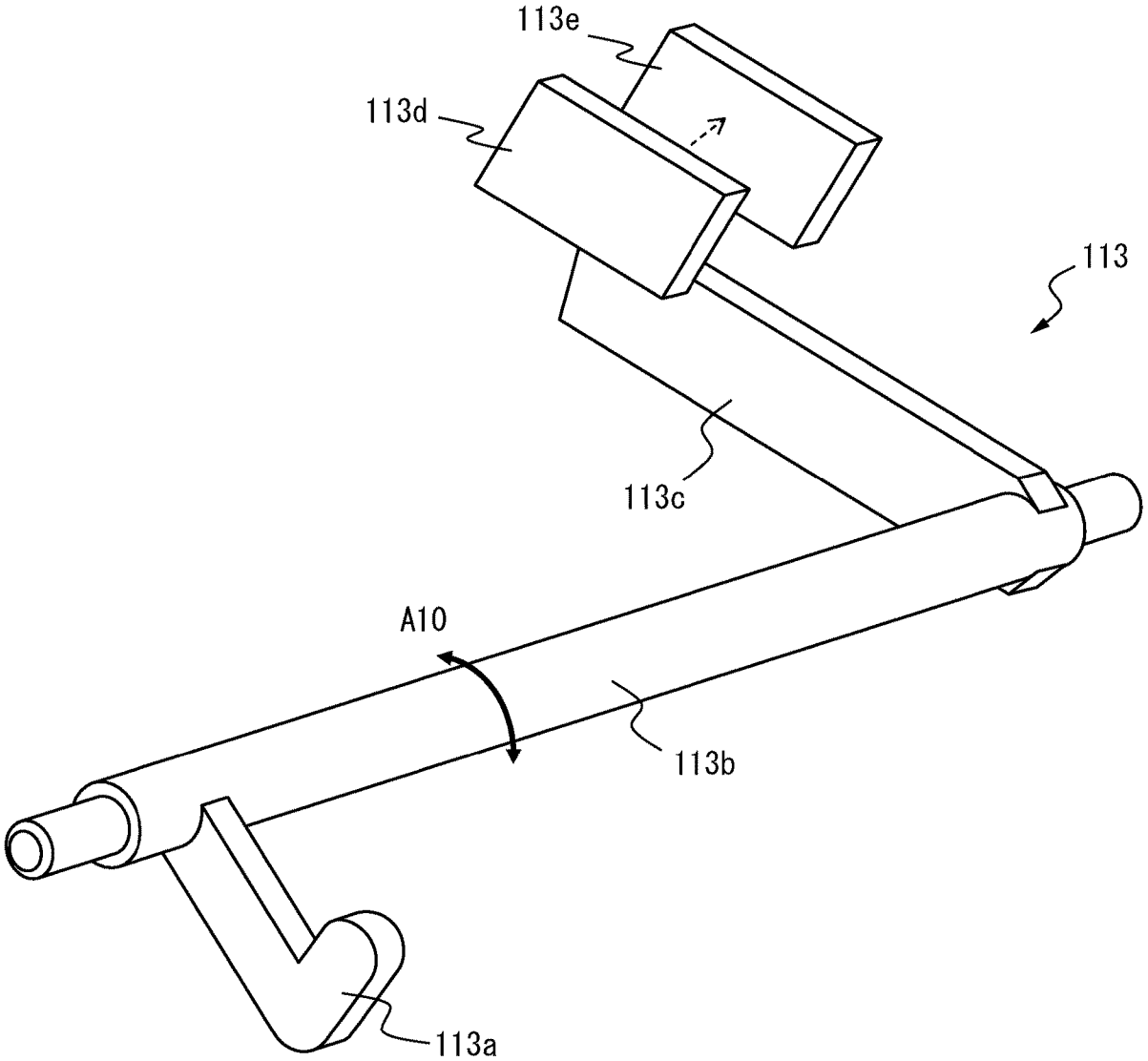
FIG. 3 is a schematic diagram for illustrating a movement sensor 113.

FIG. 3 is a schematic diagram for illustrating the movement sensor 113. FIG. 3 is a perspective view showing the movement sensor 113 removed from the medium conveying apparatus 100.

As shown in FIG. 3, the movement sensor 113 includes an arm 113*a*, a supporting portion 113*b*, a shielding portion 113*c*, a movement sensor light emitter 113*d*, a movement sensor light receiver 113*e*, etc.

The support portion 113*b* is formed in a rod shape, and is rotatably attached to a housing of the medium conveying apparatus 100 in the direction of the arrow A10. The arm 113*a* is swingably (rotatably) supported at one end of the support portion 113*b* about the support portion 113*b* as a rotation axis. The shield portion 113*c* is swingably (rotatably) supported at the other end of the support portion 113*b* about the support portion 113*b* as a rotation axis. The arm 113*a*, the supporting portion 13*b* and the shielding portion 113*c* are formed of a single member. The arm 113*a*, the supporting portion 113*b* and the shielding portion 113*c* may be formed of separate members.

The movement sensor light emitter 113*d* irradiates light toward the movement sensor light receiver 113*e*. The movement sensor light receiver 113*e* receives the light irradiated by the movement sensor light emitter 113*d*, and generates and outputs a movement amount signal which is an electric signal corresponding to the intensity of the received light. When the shielding portion 113*c* exists between the movement sensor light emitter 113*d* and the movement sensor light receiver 113*e*, the light irradiated by the movement sensor light emitter 113*d* is shielded by the shielding portion 113*c*. Therefore, the signal value of the movement amount signal changes in accordance with the position of the shielding portion 113*c*, that is, corresponding to the movement amount of the arm 113*a* that moves together with the shielding portion 113*c*.

Instead of the movement sensor light emitter 113*d* and the movement sensor light receiver 113*e*, the movement sensor 113 may include an encoder, etc., capable of measuring the amount of rotation of the support portion 113*b*, and may generate an electric signal corresponding to the amount of rotation of the support portion 113*b* as a movement amount signal.

Figure 4:
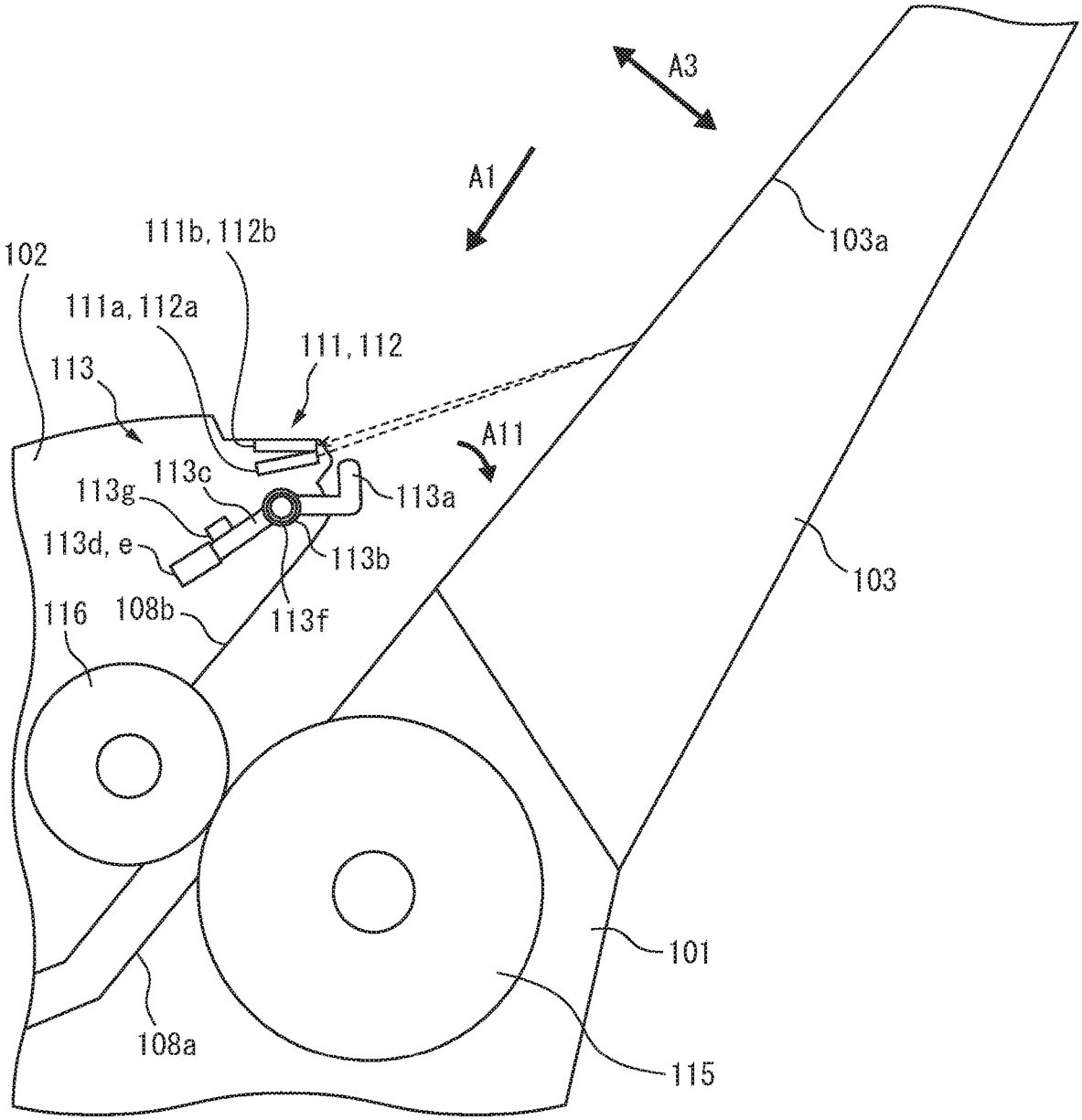
FIG. 4 is a schematic diagram for illustrating an arrangement of the first sensor 111, etc.
Figure 5:
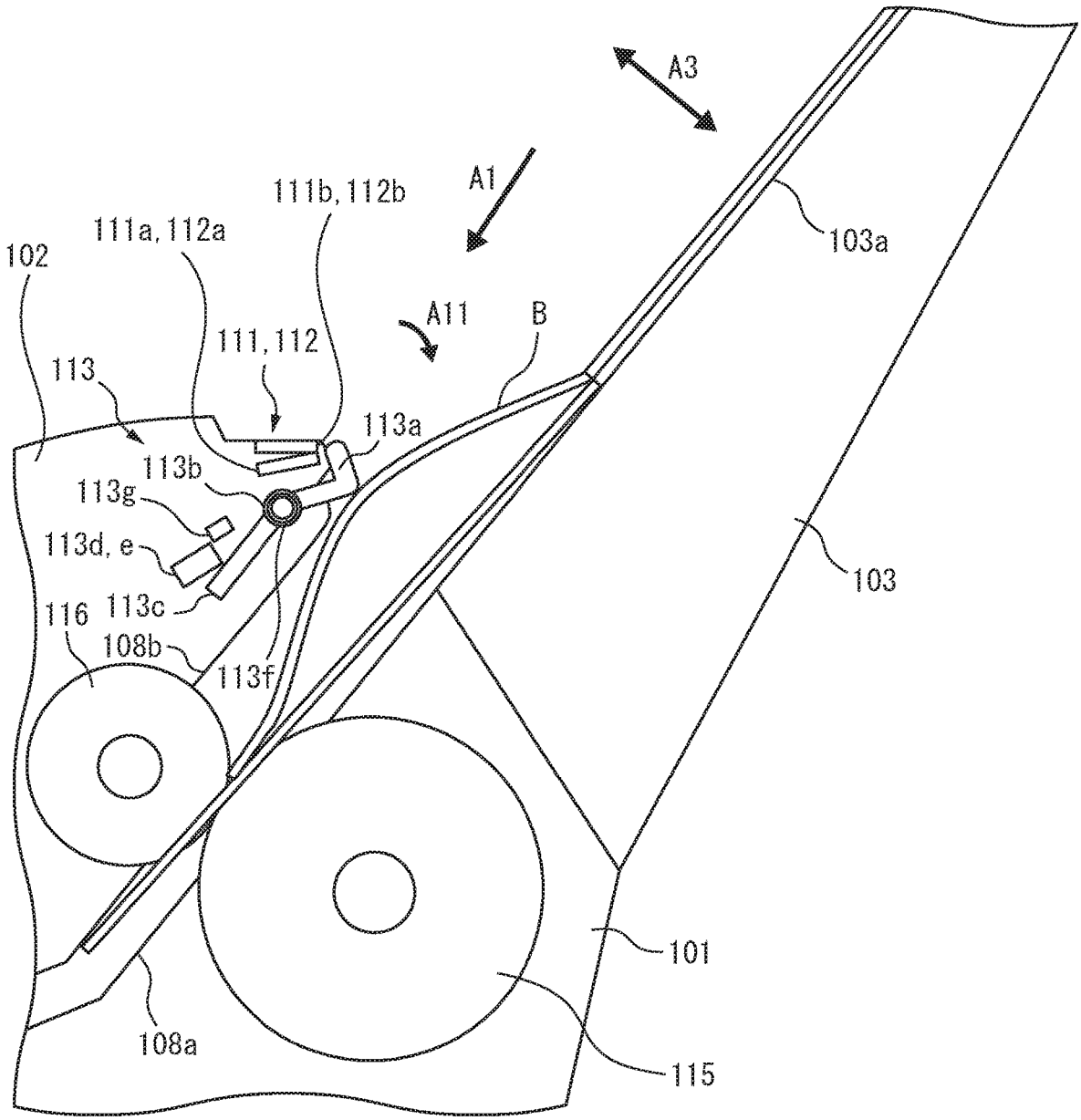
FIG. 5 is a schematic diagram for illustrating an arrangement of the first sensor 111, etc.
Figure 6:
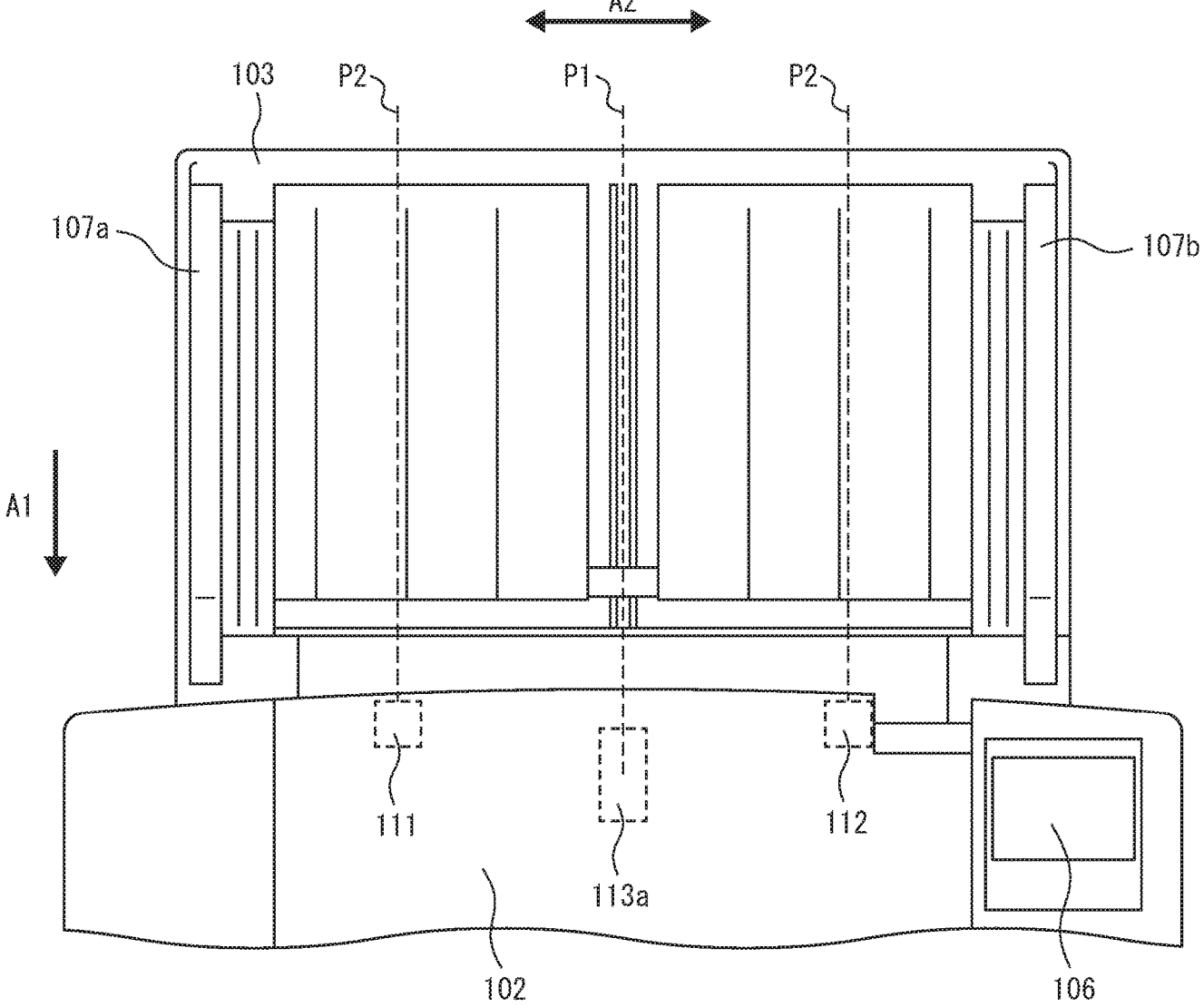
FIG. 6 is a schematic diagram for illustrating an arrangement of the first sensor 111, etc.

FIGS. 4 to 6 are schematic diagrams for illustrating the arrangement of the first sensor 111, the second sensor 112, the movement sensor 113, etc. FIGS. 4 and 5 is a schematic diagram of the upstream side of the medium conveying apparatus 100 viewed from side in a state where the side guides 107 are removed. FIG. 4 shows the medium conveying apparatus 100 in a state where the medium is not placed on the medium tray 103. FIG. 5 shows the medium conveying apparatus 100 in a state where the small booklet B is fed as a medium. FIG. 6 is a schematic diagram of the upstream side of the medium conveying apparatus 100 viewed from above.

As shown in FIGS. 4 and 5, the support portion 113*b* of the movement sensor 113 is rotatably attached to the upper housing 102. The arm 113*a* is provided on the upper guide 108*b*, that is, on the upper side with respect to the conveyance path of the medium, and on the upstream side of the feed roller 115 and the brake roller 116, so as to be able to contact the medium to be fed. In other words, the arm 113*a* is movably provided by the fed medium. A torsion coil spring 113*f* is provided between the upper housing 102 and the arm 113*a*. The torsion coil spring 113*f* is provided around the support portion 13*b* so that a force is applied to the arm 113*a* in the direction of the arrow A11, i.e., downward in the height direction A3. The torsion coil spring 113*f* is an example of an elastic member to press the arm 113*a* downward. Instead of the torsion coil spring 113*f*, a compression coil spring, a rubber member, etc., to press the arm 113*a* downward may be used as the elastic member. Further, the movement sensor 113 may not have an elastic member, and a downward force may be applied to the arm 113*a* only by its own weight.

The upper housing 102 is provided with a stopper 113*g* to stop the shielding portion 113*c*. As shown in FIG. 4, in a state where the medium is not placed on the medium tray 103, the shielding portion 113*c* is pressed upward by the arm 113*a* pressed downward by the torsion coil spring 113*f*, abuts against the stopper 113*g*, and stops. As a result, the shielding portion 113*c* is located between the movement sensor light emitter 113*d* and the movement sensor light receiver 113*e*, and the signal value of the movement amount signal indicates a state in which the arm 113*a* exists in the initial position shown in FIG. 4.

On the other hand, as shown in FIG. 5, when the small booklet B is fed and another page is separated from the page in contact with the feed roller 115 and bent, the arm 113*a* is pushed up in the direction opposite to the arrow A11 by the bent page. The shield portion 113*c* is pressed downward by the arm 113*a* pressed upward by the bent medium. As a result, the shielding portion 113*c* does not exist between the movement sensor light emitter 113*d* and the movement sensor light receiver 113*e*, and the signal value of the movement amount signal indicates a state in which the arm 113*a* does not exist in the initial position.

The pressing force by the torsion coil spring 113*f* is set to a magnitude such that the arm 113*a* rotates in the direction opposite to the arrow A11 when a load of a predetermined amount, for example, 40 gf or more is applied to the arm 113*a*. Therefore, the arm 113*a* moves when a load of a predetermined amount, for example, 40 gf or more is applied, such as when a small booklet such as a passport or a passbook is bent. On the other hand, the arm 113*a* does not move when a load less than a predetermined amount (a force of about 10 gf) is applied, such as when a partially deformed (bent) sheet is fed or when a portion of the fed sheet rises. Thus, the movement sensor 113 can accurately determine the case where the small booklet is fed and the case where the paper is fed.

The first sensor 111 is an example of a light sensor and is located on the upper guide 108*b*, i.e., on the upper side with respect to the conveyance path of the medium, and on the upstream side of the feed roller 115 and the brake roller 116. The first sensor 111 is an infrared access distance sensor and measures a distance from an object existing at a facing position, based on a time difference between emission and reflection of infrared rays. The first sensor 111 includes a first light emitter 111*a* and a first light receiver 111*b*. The first light emitter 111*a* irradiates light (infrared light) toward the mounting surface 103*a* of the medium tray 103 or the medium placed on the medium tray 103. In particular, the first light emitter 111*a* irradiates light toward a position on the upstream side in the medium conveying direction A1 and facing the first light emitter 111*a* in the width direction A2. On the other hand, the first light receiver 111*b* receives light irradiated by the first light emitter 111*a* and reflected by the mounting surface 103*a* of the medium tray 103 or the medium placed on the medium tray 103, and generates and outputs a first medium signal which is an electric signal corresponding to the received light.

The first medium signal indicates a time from when the first light emitter 111*a* irradiates light to when the first light receiver 111*b* receives light, and a light amount of light received by the first light receiver 111*b*. That is, the signal value of the first medium signal changes depending on whether or not the medium exists at the position where the first light emitter 111*a* irradiates light. Therefore, the first sensor 111 operates as a medium sensor to detect a presence of the medium at the position of the medium tray 103 at which the first light emitter 111*a* irradiates light.

Similarly, the second sensor 112 is an example of alight sensor and is located on the upper guide 108*b*, i.e., on the upper side with respect to the conveyance path of the medium, and upstream of the feed roller 115 and the brake roller 116. The second sensor 112 is an infrared access distance sensor and measures a distance from an object existing at a facing position, based on a time difference between emission and reflection of infrared rays. The second sensor 112 includes a second light emitter 112*a* and a second light receiver 112*b*. The second light emitter 112*a* irradiates light (infrared light) toward the mounting surface 103*a* of the medium tray 103 or the medium placed on the medium tray 103. In particular, the second light emitter 112*a* irradiates light toward a position on the upstream side in the medium conveying direction A1 and facing the second light emitter 112*a* in the width direction A2. On the other hand, the second light receiver 112*b* receives light irradiated by the second light emitter 112*a* and reflected by the mounting surface 103*a* of the medium tray 103 or the medium placed on the medium tray 103, and generates and outputs a second medium signal which is an electric signal corresponding to the received light.

The second medium signal indicates, for example, a time from when the second light emitter 112*a* irradiates light to when the second light receiver 112*b* receives light, and a light amount of light received by the second light receiver 112*b*. That is, the signal value of the second medium signal changes depending on whether or not the medium exists at the position where the second light emitter 112*a* irradiates light. Therefore, the second sensor 112 operates as a medium sensor to detect a presence of the medium at the position of the medium tray 103 at which the second light emitter 112*a* irradiates light.

Known infrared proximity distance sensors that can measure distances, for example, with a resolution of 1 mm in the range of 0 to 100 mm, can be utilized as the first sensor 111 and the second sensor 112. The medium conveying apparatus 100 may be located only one of the first sensor 111 or the second sensor 112, the other may be omitted.

As shown in FIG. 6, the arm 113*a* of the movement sensor 113 is located at the center of the upper housing 102 in the width direction A2. On the other hand, the first sensor 111 and the second sensor 112 are located outside the movement sensor 113 in the width direction A2.

Normally, when a small booklet such as a passport or a passbook is fed, the small booklet is placed at the center of the medium tray 103 in the width direction A2, and the side guides 107 are set so as to sandwich both ends of the small booklet. The arm 113*a* is preferably located at a position facing the small booklet placed at the center in the width direction A2 so as to be able to contact with the small booklet placed at the center when the small booklet is bent. The size in the direction along the stitched portion of the passport is 128 mm, and the size in the direction along the stitched portion of the passbook is 140 mm. The arm 113*a* is preferably located within a range of 64 mm from the central position P1 in the width direction A2 so as to be able to contact any of the passport and the passbook placed at the center.

On the other hand, the first sensor 111 and the second sensor 112 are used to detect the size of the medium placed on the medium tray 103. The first sensor 111 and the second sensor 112 are preferably located at positions not facing the passport or the passbook placed at the central and the side guide 107 sandwiching the passport or the passbook in the width direction A2. In other words, the first sensor 111 and the second sensor 112 are preferably located at a position P2 which is separated from the center position P1 by a distance acquired by adding the size of the width of the side guide 107 to 70 mm in the width direction A2. Thus, the medium conveying apparatus 100 can accurately determine whether or not the medium placed on the medium tray 103 is larger than the passport or the passbook based on the medium signals generated by the first sensor 111 and the second sensor 112.

Figure 7:
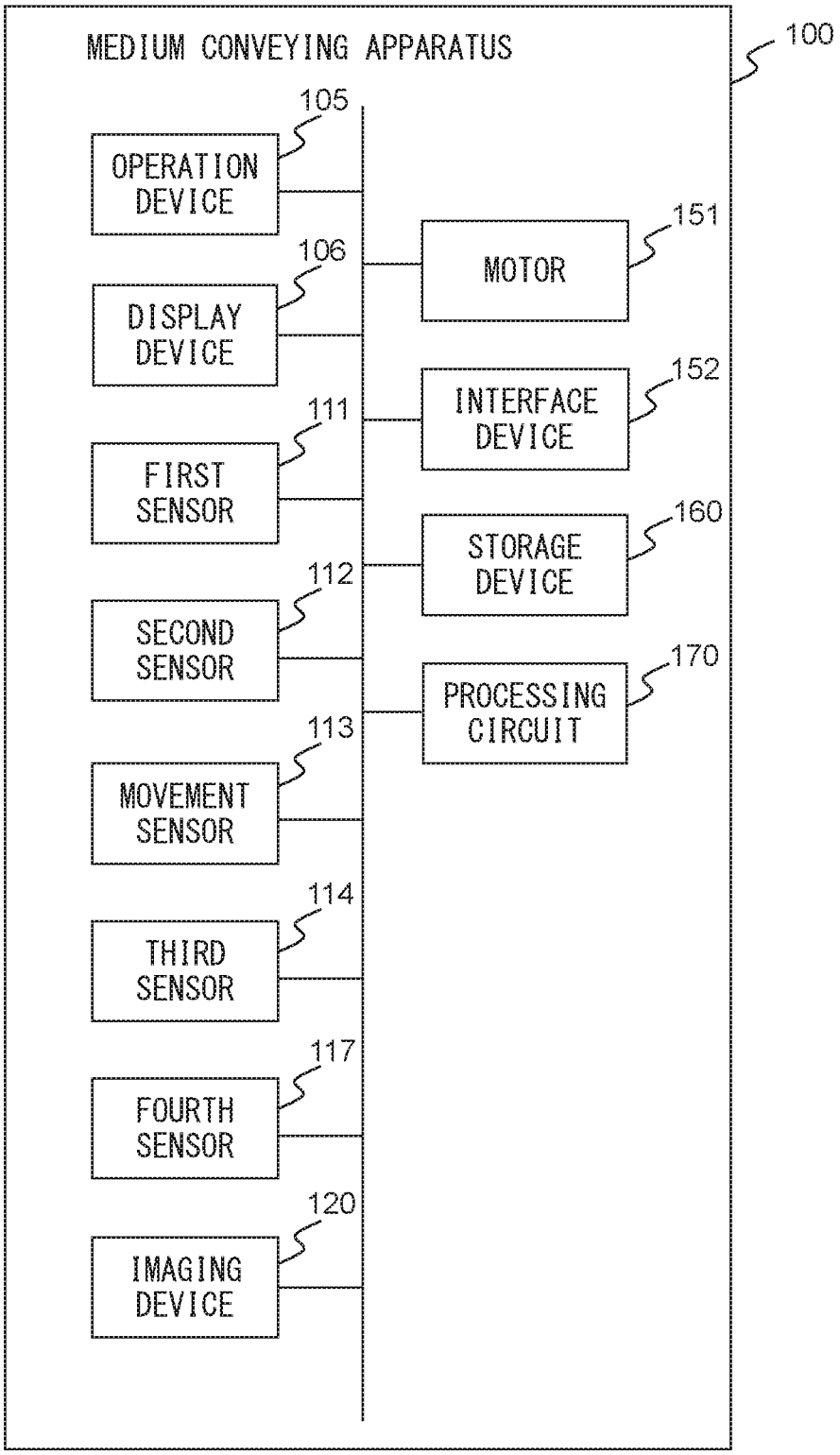
FIG. 7 is a block diagram illustrating a schematic configuration of a medium conveying apparatus 100.

FIG. 7 is a block diagram illustrating a schematic configuration of a medium conveying apparatus 100.

The medium conveying apparatus 100 further includes a motor 151, an interface device 152, a storage device 160, and a processing circuit 170, etc., in addition to the configuration described above.

The motor 151 includes one or more motors, and rotates the feed roller 115, the brake roller 116 and the first to fourth conveyance rollers 118, 119, 121, and 122 to convey the medium by a control signal from the processing circuit 170.

For example, the interface device 152 includes an interface circuit conforming to a serial bus such as universal serial bus (USB), is electrically connected to an unillustrated information processing device (for example, a personal computer or a mobile information terminal), and transmits and receives an input image and various types of information. Further, a communication module including an antenna transmitting and receiving wireless signals, and a wireless communication interface device for transmitting and receiving signals through a wireless communication line in conformance with a predetermined communication protocol may be used in place of the interface device 152. For example, the predetermined communication protocol is a wireless local area network (LAN).

The storage device 160 includes a memory device such as a random access memory (RAM) or a read only memory (ROM), a fixed disk device such as a hard disk, or a portable storage device such as a flexible disk or an optical disk. Further, the storage device 160 stores a computer program, a database, a table, etc., used for various types of processing in the medium conveying apparatus 100. The computer program may be installed on the storage device 160 from a computer-readable, non-transitory medium such as a compact disc read only memory (CD-ROM), a digital versatile disc read only memory (DVD-ROM), etc., by using a well-known setup program, etc.

The processing circuit 170 operates in accordance with a program previously stored in the storage device 160. The processing circuit 170 is, for example, a CPU (Central Processing Unit). The processing circuit 170 may be a digital signal processor (DSP), a large scale integration (LSI), an application specific integrated circuit (ASIC), a field-programmable gate array (FPGA), etc.

The processing circuit 170 is connected to the operation device 105, the display device 106, the first sensor 111, the second sensor 112, the movement sensor 113, the third sensor 114, the fourth sensor 117, the imaging device 120, the motor 151, the interface device 152 and the storage device 160, and controls each of these units. The processing circuit 170 performs drive control of the motor 151, imaging control of the imaging device 120, etc., generates an input image, and transmits the input image to the information processing apparatus via the interface device 152 In particular, the processing circuit 170 determines whether or not a feeding abnormality of the medium has occurred based on the movement amount signal generated by the movement sensor 113, and detects the size of the medium based on the medium signal generated by the first sensor 111 and the second sensor 112. The feeding abnormality of the medium is a jam (paper jam) or floating of the medium, etc. The processing circuit 170 controls the conveyance of the medium, based on the determination result and the detection result.

Figure 8:
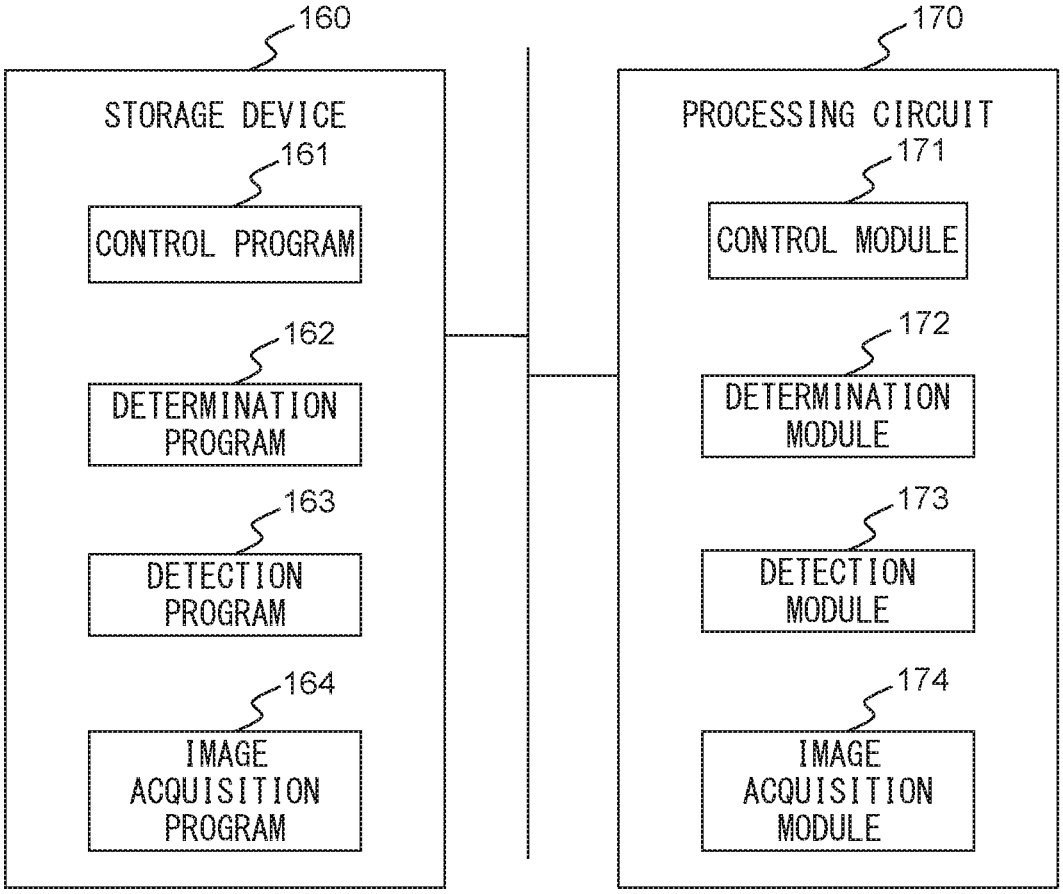
FIG. 8 is a diagram illustrating schematic configurations of a storage device 160 and a processing circuit 170.

FIG. 8 is a diagram illustrating schematic configurations of the storage device 160 and the processing circuit 170.

As illustrated in FIG. 8, a control program 161, a determination program 162, a detection program 163, an image acquisition program 164, etc., are stored in the storage device 160. Each of these programs is a functional module implemented by software operating on a processor. The processing circuit 170 reads each program stored in the storage device 160 and operates in accordance with each read program. Thus, the processing circuit 170 functions as a control module 171, a determination module 172, a detection module 173 and an image acquisition module 174.

Figure 9:
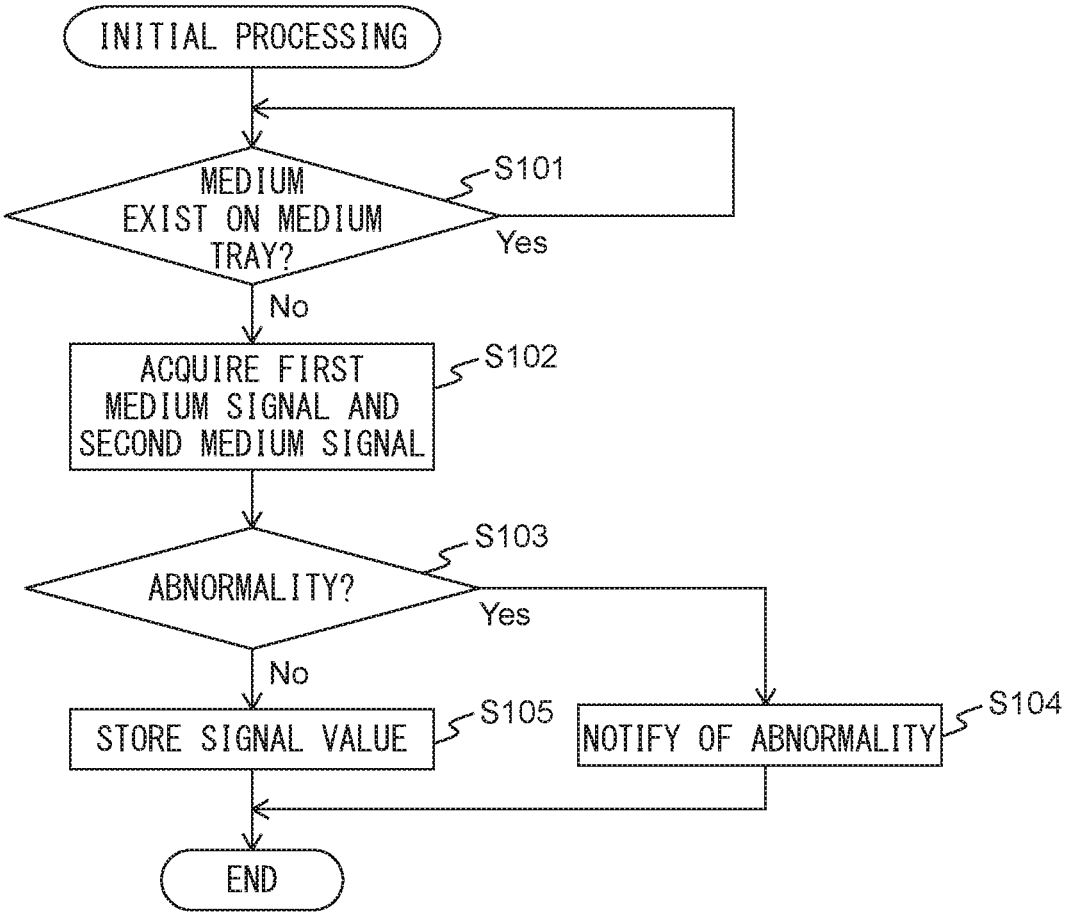
FIG. 9 is a flowchart illustrating an operation example of an initial processing.

FIG. 9 is a flowchart illustrating an operation example of the initial processing of the medium conveying apparatus 100.

Referring to the flowchart illustrated in FIG. 9, the operation example of the initial processing in the medium conveying apparatus 100 will be described below. The operation flow described below is executed mainly by the processing circuit 170 in cooperation with each element in the medium conveying apparatus 100, in accordance with a program previously stored in the storage device 160. The flow of operation shown in FIG. 9 is executed when the medium conveying apparatus 100 is started.

First, the control module 171 acquires the third medium signal from the third sensor 114, and determines whether or not the medium is placed on the medium tray 103, based on the acquired third medium signal (step S101). The control module 171 waits until a state in which the medium is not placed on the medium tray 103.

On the other hand, when the medium is not placed on the medium tray 103, the detection module 173 acquires the first medium signal from the first sensor 111 and the second medium signal from the second sensor 112, respectively (step S102).

Next, the detection module 173 determines whether or not the first sensor 111 and the second sensor 112 is normal, based on the acquired first medium signal and the second medium signal (step S103). The control module 171 determines whether or not the signal value of the first medium signal and the signal value of the second medium signal are included in the range of the time and the light amount when the medium is not placed on the medium tray 103. When the signal value of the first medium signal and the signal value of the second medium signal are not included in the range of the time and the light amount when the medium is not placed on the medium tray 103, the control module 171 considers that the first sensor 111 and the second sensor 112 are contaminated and determines that they are abnormal.

When the first sensor 111 and the second sensor 112 are abnormal, the detection module 173 notifies the user of the abnormality by displaying the abnormality on the display device 106 or transmitting the abnormality to an information processing device (not shown) via the interfacing device 152 (step S104), and ends the series of steps.

On the other hand, when the first sensor 111 and the second sensor 112 are normal, the detection module 173 stores the signal value of the first medium signal and the signal value of the second medium signal as the reference value in the storage device 160 (step S105), and ends the series of steps.

Figure 10:
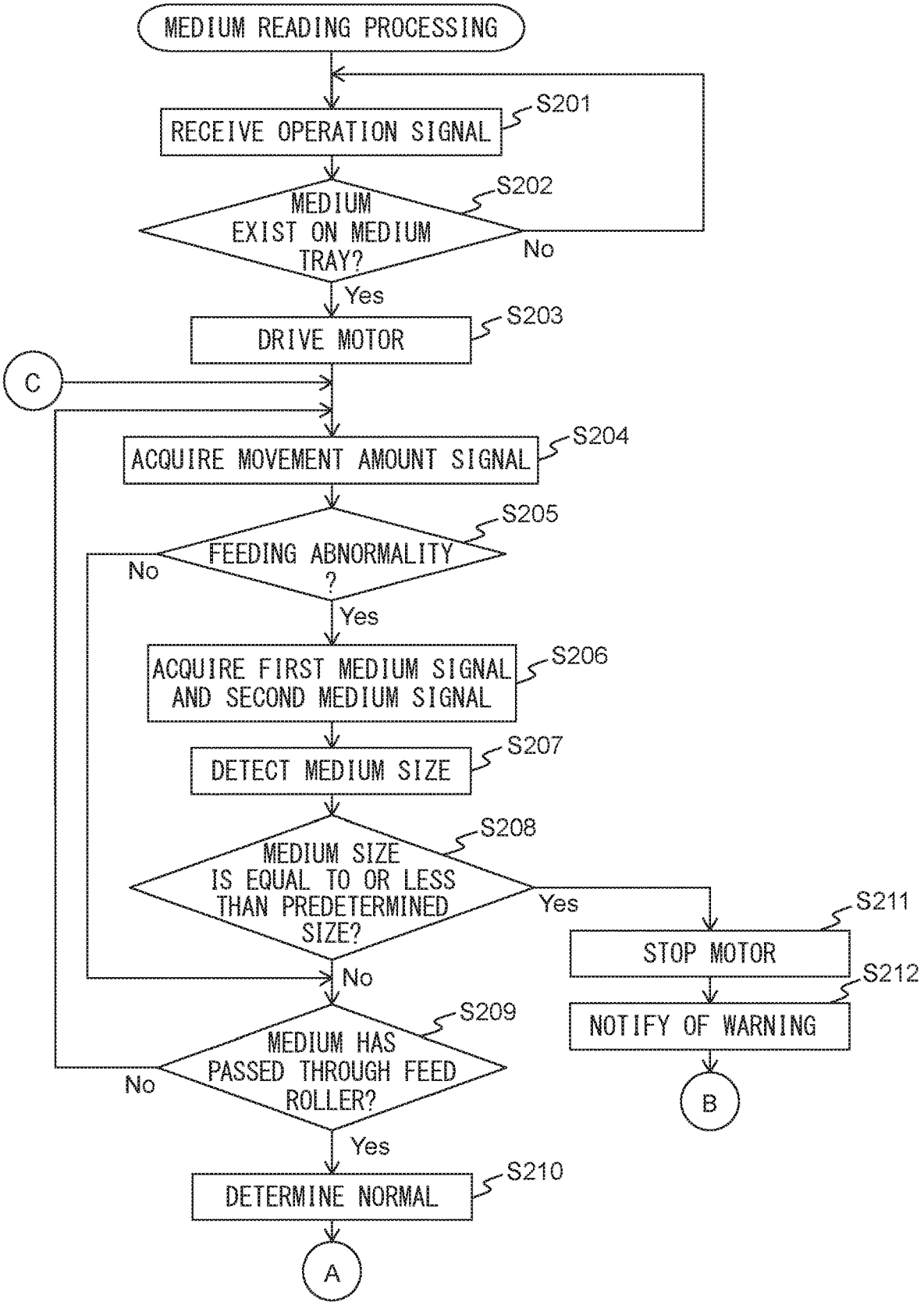
FIG. 10 is a flowchart illustrating an operation example of a medium reading processing.
Figure 11:
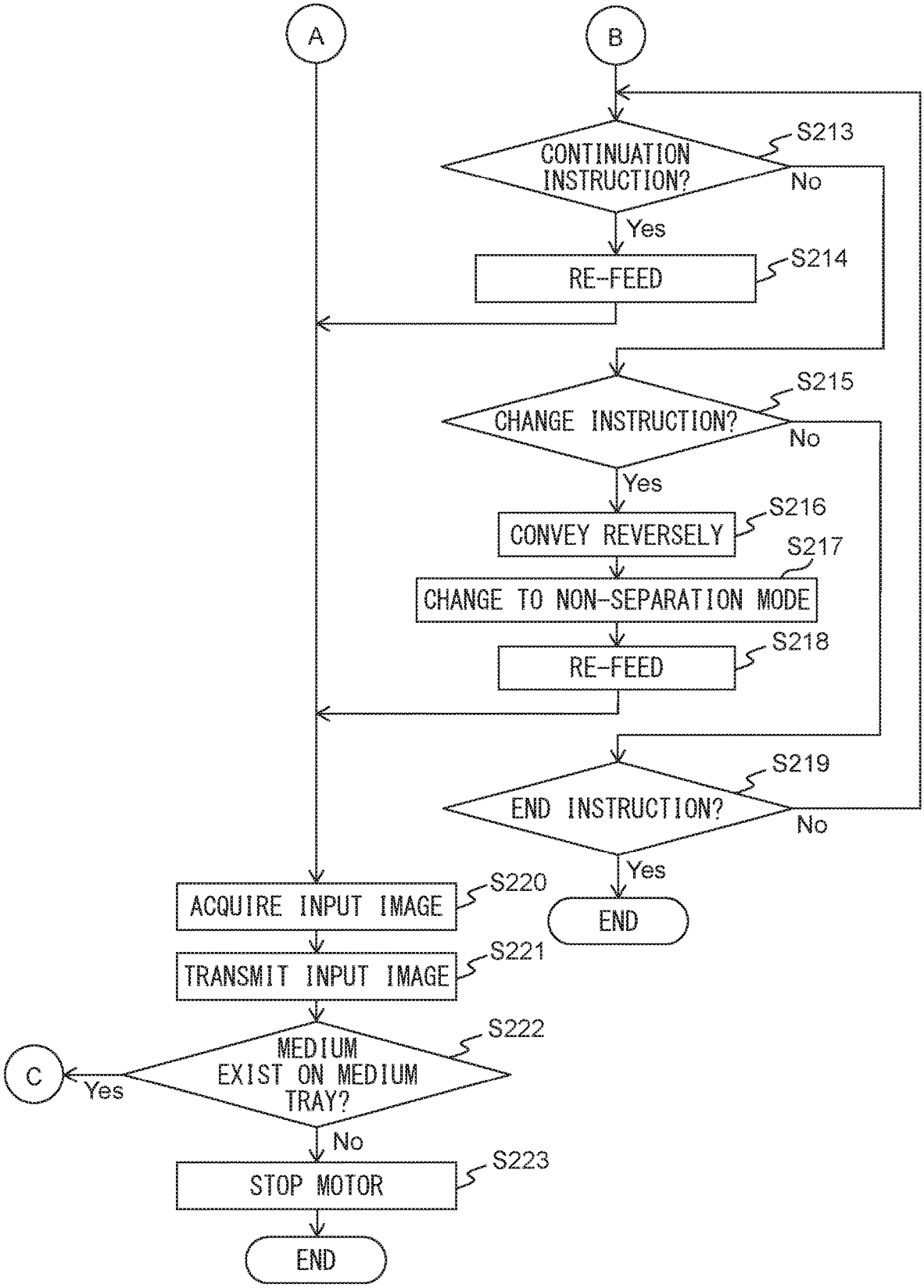
FIG. 11 is a flowchart illustrating an operation example of a medium reading processing.

FIGS. 10 and 11 are flowcharts illustrating an operation example of the medium reading processing of the medium conveying apparatus 100.

Referring to the flowchart illustrated in FIGS. 10 and 11, the operation example of the medium reading processing in the medium conveying apparatus 100 will be described below. The operation flow described below is executed mainly by the processing circuit 170 in cooperation with each element in the medium conveying apparatus 100, in accordance with a program previously stored in the storage device 160. The flow of operations shown in FIGS. 10 and 11 is performed periodically. The medium conveying apparatus 100 has a separation mode for feeding by separating a plurality of media, and a non-separation mode for feeding without separating the medium, as a feeding mode for feeding the medium. The flow of operations shown in FIGS. 10 and 11 is performed when the feeding mode is set to the separation mode.

First, the control module 171 stands by until an instruction to read a medium is input by a user by use of the operation device 105, and an operation signal instructing to read the medium is received from the operation device 105 (step S201).

Next, the control module 171 acquires the third medium signal from the third sensor 114, and determines whether the medium is placed on the medium tray 103, based on the acquired third medium signal (step S202).

When a medium is not placed on the medium tray 103, the control module 171 returns the processing to step S201 and stands by until newly receiving an operation signal from the operation device 105.

On the other hand, when the medium is placed on the medium tray 103, the control module 171 drives the motor 151 to rotate the feed roller 115, the brake roller 116, and the first to fourth conveyance rollers 118, 119, 121, and 122 to feed and convey the medium (step S203).

Next, the determination module 172 acquires the movement amount signal from the movement sensor 113 (step S204).

Next, the determination module 172 determines whether or not the feeding abnormality of the medium has occurred, based on the acquired movement amount signal (step S205). When the signal value of the movement amount signal indicates a state in which the arm 113*a* exists at the initial position, the determination module 172 determines that the fed medium is not bent (floating), and that the medium feeding abnormality has not occurred. On the other hand, when the signal value of the movement amount signal indicates a state in which the arm 113*a* does not exist at the initial position, the determination module 172 determines that the fed medium is bent and the feeding abnormality of the medium has occurred. The determination module 172 may determine that the feeding abnormality of the medium has occurred only when the signal value of the movement amount signal indicates a state in which the arm 113*a* does not exist at the initial position continuously for a predetermined period of time or longer. Thus, the determination module 172 can suppress erroneous determination that the feeding abnormality of the medium has occurred when a paper which is partially deformed is fed or a part of a fed paper floats. The determination module 172 proceeds the processing to step S209 when the determination module 172 determines that the feeding abnormality of the medium has not occurred.

On the other hand, when the determination module 172 determines that the feeding abnormality of the medium has occurred, the detection module 173 acquires the first medium signal from the first sensor 111 and the second medium signal from the second sensor 112, respectively (step S206).

Next, the detection module 173 detects the size of the medium placed on the medium tray 103, based on the acquired first medium signal and the acquired second medium signal, i.e. based on the detection result by the first sensor 111 and the second sensor 112 (step S207). The detection module 173 compares the signal value of the acquired first medium signal and the signal value of the acquired second medium signal with the reference value stored in the storage device 160, respectively.

When the difference between the time indicated in the signal value of each medium signal and the time indicated in the reference value is less than a time corresponding to a predetermined height (e.g., 10 mm), the detection module 173 determines that a medium does not exists at a position facing the first sensor 111 and the second sensor 112. In this case, the detection module 173 detects a size of the predetermined size or less, as the size of the medium placed on the medium tray 103. The predetermined size is the length acquired by subtracting the size of the width of the side guide 107 and margin from the distance between the position where the first sensor 111 is located and the position where the second sensor 112 is located, for example, the size of the direction along the stitched portion of a passport or a passbook. On the other hand, when the difference between the time indicated in the signal value of each medium signal and the time indicated in the reference value is equal to or more than a time corresponding to the predetermined height, the detection module 173 determines that the medium exists at a position facing the first sensor 111 and the second sensor 112. In this case, the detection module 173 detects a size larger than the predetermined size, as the size of the medium placed on the medium tray 103.

Next, the control module 171 determines whether or not the size of the medium detected by the detection module 173 is equal to or less than the predetermined size (step S208).

When the size of the medium is larger than the predetermined size, the control module 171 considers that the jam of the medium has not occurred and determines whether or not the front end of the medium has passed through the positions of the feed roller 115 and the brake roller 116 (step S209). The control module 171 determines whether or not the front end of the medium has passed through the positions of the feed roller 115 and the brake roller 116 based on the detection result of the fourth sensor 117. The control module 171 acquires the fourth medium signal periodically from the fourth sensor 117, and determines whether or not the medium exists at the position of the fourth sensor 117, based on the acquired fourth medium signal. When a signal value of the fourth medium signal changes from a value indicating nonexistence of a medium to a value indicating existence of a medium, the control module 171 determines that the front end of the medium has passed through the position of the fourth sensor 117 and passed through the positions of the feed roller 115 and the brake roller 116.

The control module 171 may determine whether or not the front end of the medium has passed through the positions of the feed roller 115 and the brake roller 116 without using the fourth sensor 117. For example, the control module 171 may determine that the front end of the medium has passed through the positions of the feed roller 115 and the brake roller 116 when a predetermined time has elapsed since the start of feeding the medium (driving the motor 151). The predetermined time is set to the time required for the front end of the medium to pass through the positions of the feed roller 115 and the brake roller 116 after the feeding of the medium is started, by the prior experiment. Further, the control module 171 may determine that the front end of the medium has passed through the position of the feed roller 115 and the brake roller 116 when the motor 151 is driven (rotated) by a predetermined amount. The predetermined amount is set to an amount of rotation required for the front end of the medium to pass through the positions of the feed roller 115 and the brake roller 116 after the feeding of the medium is started, by the prior experiment.

The control module 171 returns the processing to step S204 and repeats the processing of step S204 to S209 when the control module 171 determines that the front end of the medium has not passed through the positions of the feed roller 115 and the brake roller 116.

On the other hand, when the control module 171 determines that the front end of the medium has passed through the positions of the feed roller 115 and the brake roller 116, the control module 171 determines that the feeding of the medium is normal (step S210), and proceeds the processing to step S220.

On the other hand, when the control module 171 determines that the size of the medium is equal to or less than the predetermined size in the step S208, the control module 171 controls the motor 151 to stop feeding by the feed roller 115 and the brake roller 116 (step S211).

Thus, the control module 171 stops feeding of the medium by the feed roller 115 and the brake roller 116 when the determination module 172 determines that the feeding abnormality of the medium has occurred and the size of the medium detected by the detection module 173 is equal to or less than the predetermined size. That is, the control module 171 considers that the small booklet is fed, and a jam has occurred without being separated by the separation unit when it is determined that the feeding abnormality of the medium has occurred, and the size of the medium is equal to or less than the predetermined size. On the other hand, the control module 171 considers that the paper larger than the small booklet is fed and only a part of the paper is deformed or floated, and thus the jam has not occurred, when the size of the medium is larger than the predetermined size, even when it is determined that the feeding abnormality of the medium has occurred. In this case, the control module 171 does not stop the feeding of the medium. Thus, the control module 171 can suppress erroneously determination that the jam of the medium has occurred, and stop the feeding of the medium.

Next, the control module 171 displays a warning screen on the display device 106 or transmits the warning screen to an information processing device (not shown) via the interface device 152, thereby notifying the user of the warning screen (step S212).

Figure 12:
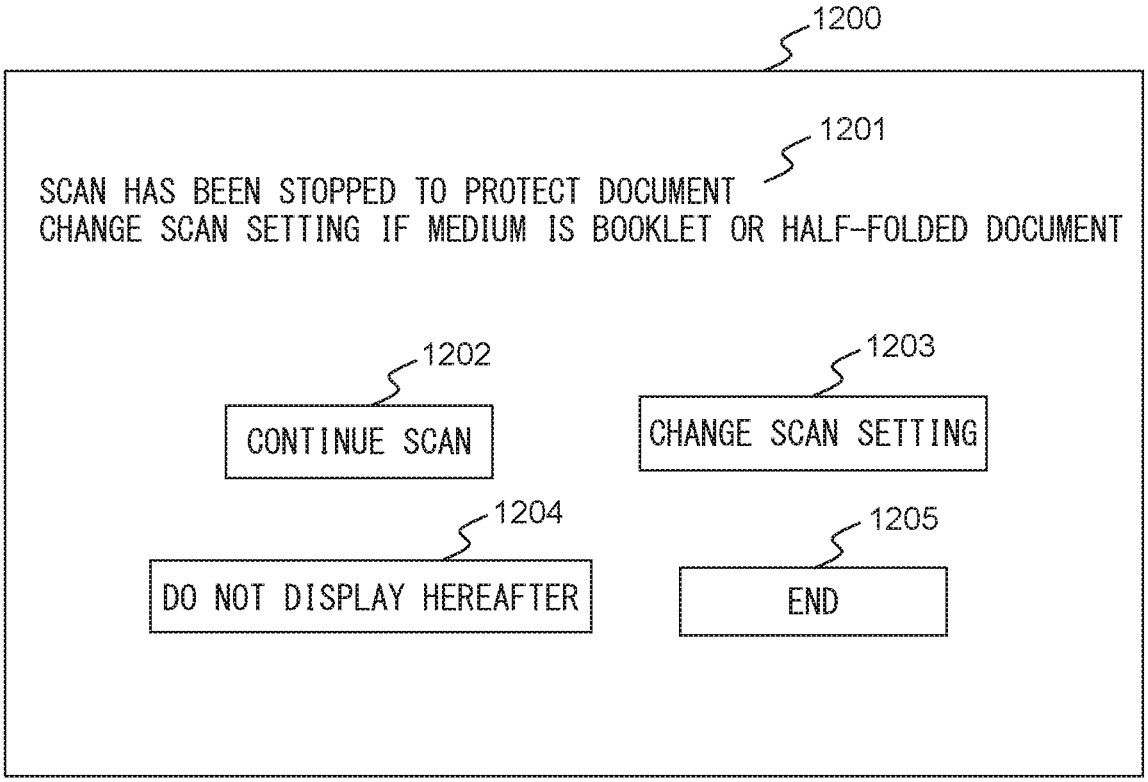
FIG. 12 is a schematic diagram illustrating an example of a warning screen 1200.

FIG. 12 is a schematic diagram illustrating an example of the warning screen 1200.

As shown in FIG. 12, a warning character string 1201, a continuation button 1202, a change button 1203, a non-display button 1204, and an end button 1205, etc., are displayed on the warning screen 1200. The warning string 1201 indicates that the feeding of the medium has been stopped since it is determined that the feeding abnormality of the medium has occurred, and prompts the feeding mode to be changed from the separation mode to the non-separation mode. The continuation button 1202 is a button for instructing to continue the feeding of the medium while the feeding mode is set to the separation mode. The change button 1203 is a button for instructing to change the feed mode from the separation mode to the non-separation mode. The non-display button 1204 is a button for indicating that the warning screen 1200 will not be displayed hereafter. The end button 1205 is a button for instructing to terminate the feeding of the medium.

The control module 171 determines whether or not the continuation button 1202 is pressed using the operating device 105 by the user, and the continuation instruction is specified (step S213).

When the continuation instruction is specified, the control module 171 re-drives the motor 151 without changing the feed mode in the separation mode. In this case, the control module 171 re-rotates the feed roller 115, the brake roller 116, and the first to fourth conveyance rollers 118, 119, 121, and 122 to feed and convey the medium (step S214), and proceeds the processing to step S220.

On the other hand, when the continuation instruction is not specified, the control module 171 determines whether or not the change button 1203 is pressed using the operating device 105 by the user, the change instruction is specified (step S215).

When the change instruction is specified, the control module 171 drives the motor 151 to rotate the feed roller 115 and the first to fourth conveyance rollers 118, 119, 121, and 122 in directions opposite to the arrows A4, A6, A7, A8, and A9 (the medium feeding direction or the medium conveying direction), respectively. Further, the control module 171 drives the motor 151 to rotate the brake roller 116 in the direction of the arrow A5 (the direction opposite to the medium feeding direction). Thus, the control module 171 conveys reversely the medium, and once returns the medium to the medium tray 103 (step S216).

Next, the control module 171 changes the feeding mode from the separation mode to the non-separation mode (step S217). In the non-separation mode, the control module 171 rotates the feed roller 115 and the first to fourth conveyance rollers 118, 119, 121, and 122 in the directions of the arrows A4, A6, A7, A8, and A9 (the medium feeding direction or the medium conveying direction), respectively. Further, in the non-separation mode, the control module 171 shuts off the driving force from the motor 151 to the brake roller 116 to turn off the separating function of the medium to be fed. The control module 171 may turn off the separation function of the medium to be fed by rotating the brake roller 116 in the medium feeding direction (the direction opposite to the arrow A5) or by reducing the separation force by the brake roller 116.

Next, the control module 171 re-drives the motor 151 to re-rotate the feed roller 115 and the first to fourth conveyance rollers 118, 119, 121, and 122 in the medium feeding direction or the medium conveying direction to re-feed and re-convey the medium (step S218). Next, the control module 171 proceeds the processing to step S220. At this time, the brake roller 116 is driven by the feed roller 115 or rotates in the medium feeding direction by the motor 151 so as not to separate the medium.

Thus, the control module 171 once returns the medium to the medium tray 103, and controls the feed roller 115 and the brake roller 116 so as to re-feed without separation when the control module 171 stops the feeding of the medium by the feed roller 115 and the brake roller 116. Consequently, a user does not need to re-feed the media by turning off the separation function of the medium, and the control module 171 can improve the convenience of the user. The processing of step S216 and S218 may be omitted, the control module 171 may only execute the change of the feed mode while stopping the feeding and conveying of the medium when the change instruction is specified. In that case, the user does not need to change the feeding mode, the control module 171 can improve the convenience of the user.

On the other hand, when the change instruction is not specified, the control module 171 determines whether or not the end button 1205 is pressed using the operating device 105 by the user, the end instruction is specified (step S219).

When the end instruction is specified, the control module 171 ends the series of steps. In this case, the medium is left at a position stopped in step S211 and removed by the user. On the other hand, when the end instruction is not specified, the control module 171 returns the processing to step S213, repeats the processing of step S213 to S219.

Further, the control module 171 accepts the designation of the non-display instruction when the non-display button 1204 is pressed using the operation device 105 by the user. In that case, the control module 171 does not perform the processing of the step S213 to S219 even when the feeding abnormality of the medium occurs and the size of the medium is equal to or less than the predetermined size thereafter. That is, the control module 171 ends the series of steps without displaying the warning screen, while leaving the medium at the position stopped in step S211.

On the other hand, in step S220, the image acquiring unit 174 causes the imaging device 120 to start imaging of the medium, and acquires an input image from the imaging device 120 (step S220).

Next, the image acquisition module 174 transmits the input image to the information processing device through the interface device 152 (step S221). When not being connected to the information processing device, the image acquisition module 174 stores the input image in the storage device 160.

Next, the control module 171 determines whether or not the medium remains on the medium tray 103 based on the third medium signal acquired from the third sensor 114 (step S222). When a medium remains on the medium tray 103, the control module 171 returns the processing to step S204 and repeats the processing in steps S204 to S222.

On the other hand, when a medium does not remain on the medium tray 103, the control module 171 stops the motor 151 (step S223), and terminates the series of steps.

The control module 171 may omit the initial processing of FIG. 7, may determine whether or not the feeding abnormality of the medium has occurred using a reference value which has been set in advance. Further, when the control module 171 cannot acquire the reference value in step S105 of FIG. 7, the control module 171 may omit the processing of step S204 to S219 and omit the determination of whether or not the feeding abnormality of the medium has occurred. Alternatively, the control module 171 may omit the processing of step S207 to S208, and may stop the feeding of the medium without determining whether or not the size of the medium is equal to or less than a predetermined size when the feeding abnormality of the medium has occurred.

Further, the control module 171 considers that the second and subsequent media are the same type media as the first medium, that is, the paper, and may omit the determination of the feeding abnormality for the second and subsequent media when the medium remains in the medium tray 103 in step S222. Thus, the control module 171 can shorten the processing time of the medium reading processing.

As described in detail above, the medium conveyance apparatus 100 determines the occurrence of the feed abnormality of the medium based on the movement of the arm 113*a* located on the upstream side of the feed roller 115 and the brake roller 116. The medium conveying apparatus 100 stops feeding the medium when the feeding abnormality of the medium occurs and the size of the medium is less than the predetermined size. Thus, the medium conveying apparatus 100 can stop the feeding so as not to damage the small booklet when medium conveying apparatus 100 feeds the booklet by mistake in the separation mode. Further, the medium conveying apparatus 100 can suppress erroneously determination that the jam of the medium has occurred, thereby stopping the feeding of the medium when the paper larger than the small booklet is fed and a part of the paper is deformed or floated. Therefore, the medium conveying apparatus 100 can suitably control the feeding of the medium.

In addition, since the medium conveyance apparatus 100 determines the occurrence of the feeding abnormality based on the movement of the arm 113*a*, the medium conveyance apparatus 100 suppress erroneous determination that the feeding abnormality has occurred when a part of the paper is deformed or floated. When the medium conveying apparatus determines the occurrence of the feeding abnormality based on a detection result of an optical sensor or an imaging sensor, the medium conveying apparatus may erroneously determine that the feeding abnormality of the medium has occurred when a part of the paper is deformed or floated.

Therefore, the medium conveying apparatus 100 can determine whether or not the feeding abnormality of the medium has occurred with high accuracy, relative to the case of determining the occurrence of the feeding abnormality based on the detection result of the optical sensor or the imaging sensor.

Figure 13:
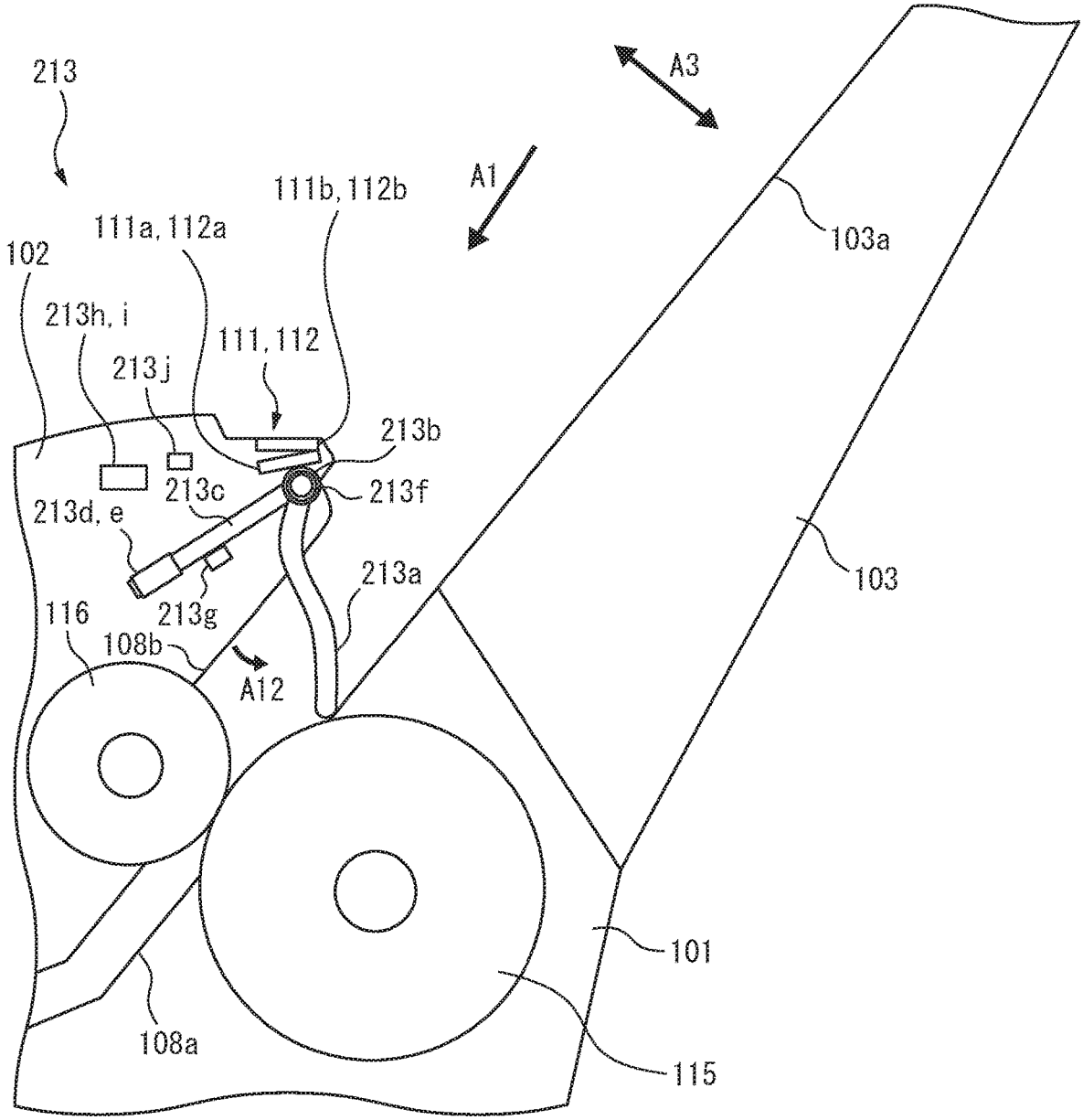
FIG. 13 is a schematic diagram for illustrating another movement sensor 213.
Figure 14:
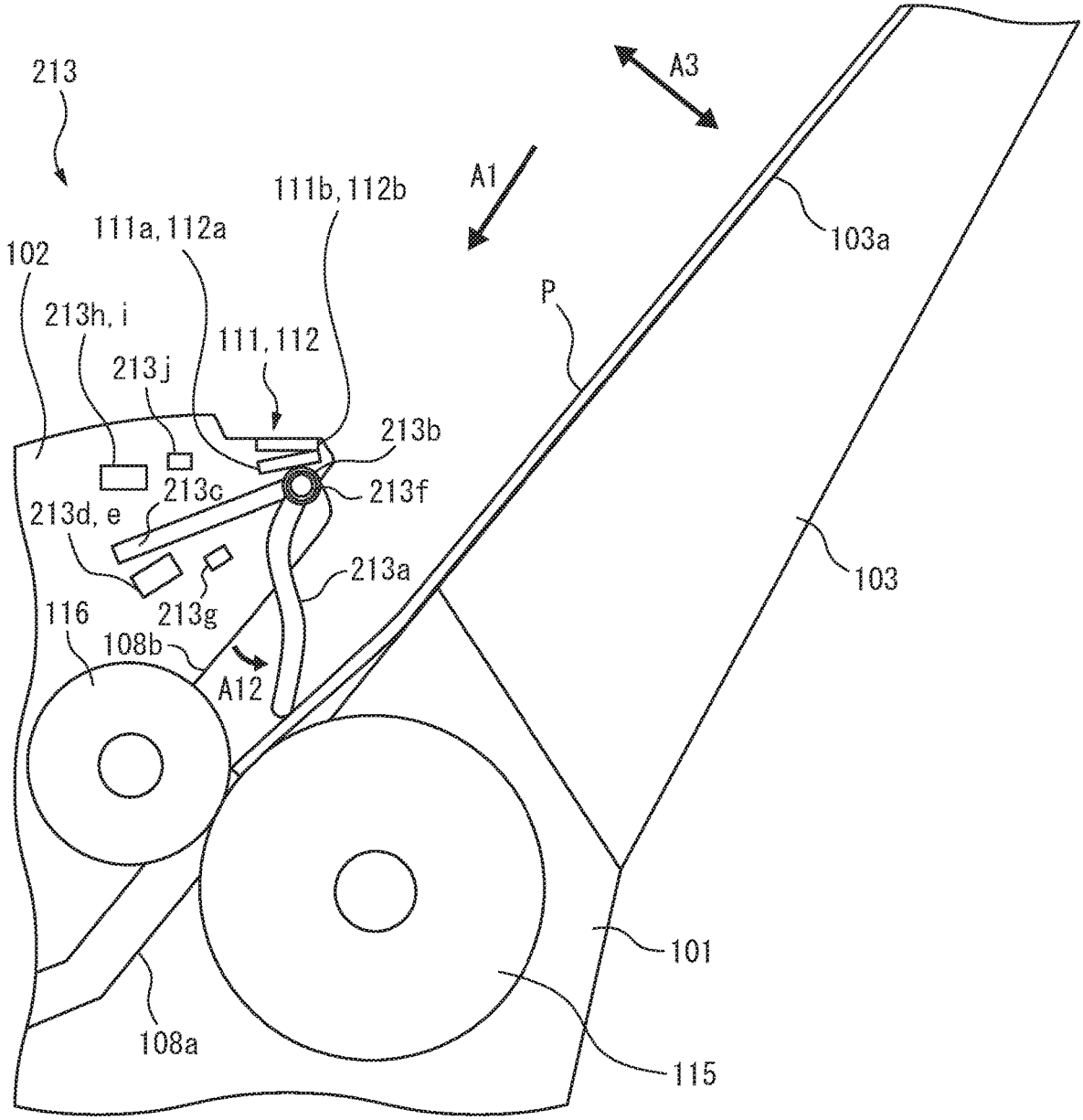
FIG. 14 is a schematic diagram for illustrating another movement sensor 213.
Figure 15:
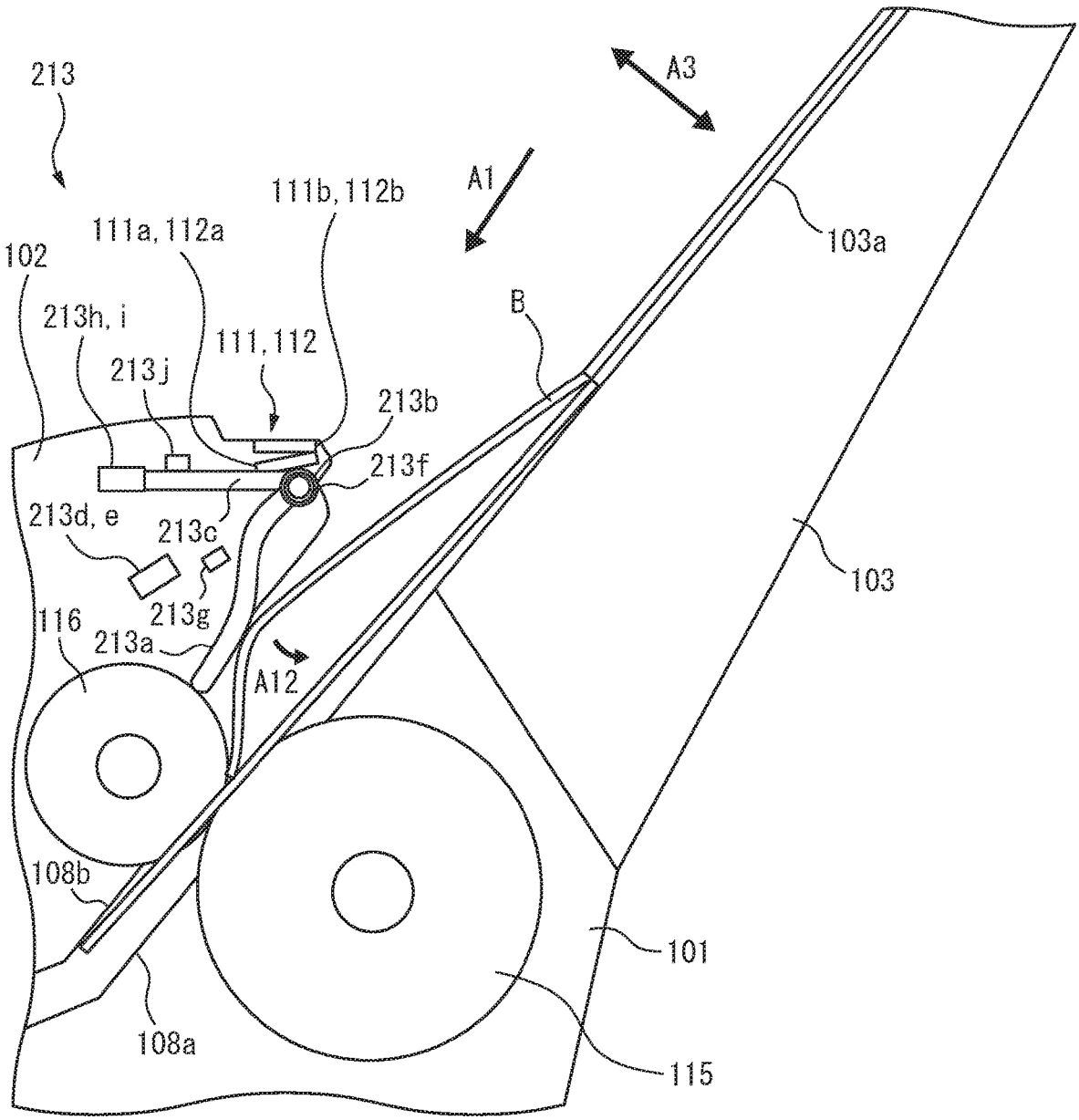
FIG. 15 is a schematic diagram for illustrating another movement sensor 213.

FIGS. 13 to 15 are schematic diagrams for illustrating a movement sensor 213 in a medium conveying apparatus according to another embodiment. FIGS. 13 to 15 are schematic diagrams of the upstream side of the medium conveying apparatus viewed from side in a state where the side guides 107 are removed. FIG. 13 shows the medium conveying apparatus in a state where no medium is placed on the medium tray 103. FIG. 14 shows the medium conveying apparatus in a state where a paper P is placed on the medium tray 103 as a medium. FIG. 15 shows the medium conveying apparatus in a state where a small booklet B is fed as a medium.

The movement sensor 213 is used in place of the movement sensor 113 and the third sensor 114 of the medium conveying apparatus 100. As shown in FIGS. 13 to 15, the movement sensor 213 includes an arm 213*a*, a supporting portion 213*b*, a shielding portion 213*c*, a first movement sensor light emitter 213*d*, a first movement sensor light receiver 213*e*, a torsion coil spring 213*f*, a first stopper 213*g*, a second movement sensor light emitter 213*h*, a second movement sensor light receiver 213*i* and a second stopper 213*j*, etc.

Similar to the support portion 113*b*, the support portion 213*b* is formed in a rod shape. Similar to the arm 113*a*, the arm 213*a* is swingably (rotatably) supported at one end of the support portion 213*b* about the support portion 213*b* as a rotation axis. Similar to the shielding portion 113*c*, the shielding portion 213*c* is swingably (rotatably) supported at the other end of the supporting portion 213*b* about the supporting portion 213*b* as a rotation axis.

The first movement sensor light emitter 213*d* irradiates light toward the first movement sensor light receiver 213*e*. The first movement sensor light receiver 213*e* receives the light irradiated by the first movement sensor light emitter 213*d*, generates and outputs a first movement amount signal which is an electric signal corresponding to the intensity of the received light. The second movement sensor light emitter 213*h* irradiates light toward the second movement sensor light receiver 213*i*. The second movement sensor light receiver 213*i* receives the light irradiated by the second movement sensor light emitter 213*h*, generates and outputs a second movement amount signal which is an electric signal corresponding to the intensity of the received light. The movement sensor 213 generates and outputs a signal including the first movement amount signal and the second movement amount signal as a movement amount signal corresponding to the movement amount of the arm 113*a*.

As shown in FIGS. 13 to 15, the support portion 213*b* is rotatably attached to the upper housing 102. The arm 213*a* is provided on the upper guide 108*b* and on the upstream side of the feed roller 115 and the brake roller 116 so as to be able to contact the medium to be fed. In other words, the arm 213*a* is movably provided by the fed medium. A torsion coil spring 213*f* is provided between the upper housing 102 and the arm 213*a*. The torsion coil spring 213*f* is provided around the support portion 213*b* so that a force is applied to the arm 213*a* in the direction of the arrow A12 (downward).

As shown in FIG. 13, in a state where a medium is not placed on the medium tray 103, the shielding portion 213*c* is pressed downward by the arm 213*a* pressed downward by the torsion coil spring 213*f*, abuts against the first stopper 213*g*, and stops. As a result, the shielding portion 213*c* is located between the first movement sensor light emitter 213*d* and the first movement sensor light receiver 213*e*, and the signal value of the first movement amount signal indicates a state in which the arm 213*a* is in the initial position shown in FIG. 13.

On the other hand, as shown in FIG. 14, when the sheet P is placed on the medium tray 103, the arm 213*a* is slightly pushed up in the direction opposite to the arrow A12 by the sheet P. The shielding portion 213*c* is pressed upward by the arm 213*a* pressed upward by the paper P. As a result, the shielding portion 213*c* does not exist between the first movement sensor light emitter 213*d* and the first movement sensor light receiver 213*e*, and the signal value of the first movement amount signal indicates a state in which the arm 213*a* does not exist at the initial position. Further, the shielding portion 213*c* does not exist between the second movement sensor light emitter 213*h* and the second movement sensor light receiver 213*i*, and the signal value of the second movement amount signal indicates a state in which the arm 213*a* does not exist in the abnormal position.

As shown in FIG. 15, when the small booklet B is fed and another page is separated from the page in contact with the feed roller 115 and bent, the arm 213*a* is greatly pushed up in the direction opposite to the arrow A12 by the bent page. The shielding portion 213*c* is pushed upward by the arm 213*a* pushed upward by the bent medium, abuts against the second stopper 213*j*, and stops. As a result, the shielding portion 213*c* is located between the second movement sensor light emitter 213*h* and the second movement sensor light receiver 213*i*, and the signal value of the second movement amount signal indicates a state in which the arm 213*a* is in the abnormal position shown in FIG. 15.

In the present embodiment, in step S101 of FIG. 9 and step S202, S222 of FIG. 10, the control module 171 acquires the movement amount signal from the movement sensor 213, and determines whether a medium is placed on the medium tray 103, based on the first movement amount signal included in the movement amount signal. When the signal value of the first movement amount signal indicates a state in which the arm 213*a* exists at the initial position, the control module 171 determines that the medium is not placed on the medium tray 103. On the other hand, when the signal value of the first movement amount signal indicates a state in which the arm 213*a* does not exist at the initial position, the control module 171 determines that the medium is placed on the medium tray 103.

Further, in step S204 of FIG. 10, the control module 171 acquires the movement amount signal from the movement sensor 213, and in step S205, the control module 171 determines whether or not the feeding abnormality of the medium has occurred, based on the second movement amount signal included in the movement amount signal. When the signal value of the second movement amount signal indicates a state in which the arm 213*a* does not exist at the abnormal position, the control module 171 determines that the medium feeding abnormality has not occurred. On the other hand, when the signal value of the second movement amount signal indicates a state in which the arm 213*a* exists at the abnormal position, the control module 171 determines that the medium feeding abnormality has occurred.

Thus, the control module 171 determines whether or not the medium is placed on the medium tray 103, in addition to determining whether or not the feeding abnormality of the medium has occurred, based on the movement amount signal. As a result, the medium conveyance apparatus can also use a sensor for determining whether or not the feeding abnormality of the medium has occurred as a sensor for determining whether or not the medium is placed on the medium tray 103, and thus, can reduce the apparatus cost and the apparatus weight.

The movement sensor 213 may have an encoder, etc., capable of measuring a rotation amount of the support portion 213*b*, and generate an electric signal corresponding to the rotation amount of the support portion 213*b* as a movement amount signal. In that case, the control module 171 determines whether or not the feeding abnormality of the medium has occurred, and whether or not a medium is placed on the medium tray 103, based on the rotation amount of the support portion 213*b* indicated in the movement amount signal.

As described in detail above, the medium conveying apparatus can suitably control the feeding of the medium even when determining whether a medium is placed on the medium tray 103 using a movement sensor.

The medium conveying apparatus may use a sensor different from the first sensor 111 and the second sensor 112, as a medium sensor to detect the presence of the medium at the predetermined position of the medium tray 103. For example, the medium conveying apparatus may locate an imaging sensor in place of the first sensor 111 and the second sensor 112 and detect a medium from the image captured by the imaging sensor using known image processing techniques to detect the presence of the medium at the predetermined position of the medium tray 103. The medium conveying apparatus may locate a contact sensor in place of the first sensor 111 and the second sensor 112 and determine whether or not the medium is in contact with the contact sensor to detect the presence of the medium at the predetermined position of the medium tray 103. Further, the medium conveyance apparatus may locate a weight sensors at a plurality of positions on the mounting surface 103*a*, and determine whether or not the medium exists at each position based on the weight measured by each weight sensor to detect the presence of the medium at the predetermined position of the medium tray 103. Further, the medium conveyance apparatus may locate a light sensor, an imaging sensor, or a contact sensor to detect a disposition position of the side guide 107, and detect a region sandwiched between the side guides 107*a* and 107*b* as a region where the medium exists.

Figure 16:
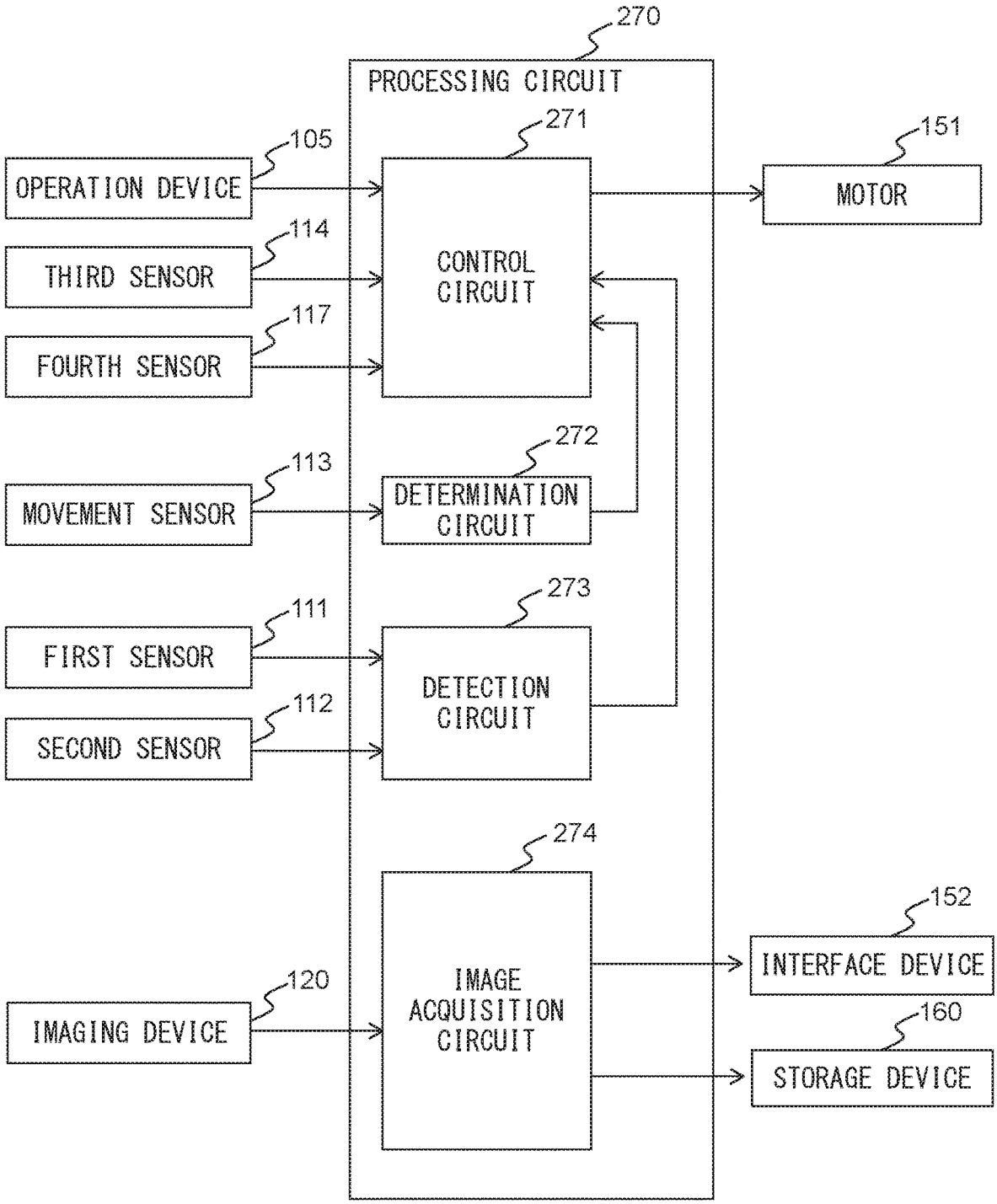
FIG. 16 is a diagram illustrating a schematic configuration of another processing circuit 270.

FIG. 16 is a diagram illustrating a schematic configuration of a processing circuit 270 in a medium conveying apparatus according to another embodiment. The processing circuit 270 is used in place of the processing circuit 170 in the medium conveying apparatus 100 and executes the medium reading processing in place of the processing circuit 170. The processing circuit 270 includes a control circuit 271, a determination circuit 272, a detection circuit 273 and an image acquisition circuit 274, etc. Note that each unit may be configured by an independent integrated circuit, a microprocessor, firmware, etc.

The control circuit 271 is an example of a control module and has a function similar to the control module 171. The control circuit 271 receives the operation signal from the operation device 105, the third medium signal from the third sensor 114, the fourth medium signal from the fourth sensor 117, the determination result of the feeding abnormality of the medium from the determination circuit 272, the detection result of the size of the medium from the detection circuit 273. The control circuit 271 outputs a control signal to the motor 151 so as to control the feeding and conveying of the medium in response to received information.

The determination circuit 272 is an example of a determination module has a functions similar to the determination module 172. The determination circuit 272 receives the movement amount signal from the movement sensor 113, determines whether or not the feeding abnormality of the medium has occurred based on the received movement amount signal, and outputs the determination result to the control circuit 271.

The detection circuit 273 is an example of a detection module, and has a functions similar to the detection module 173. The detection circuit 273 receives the first medium signal from the first sensor 111, the second medium signal from the second sensor 112, detects the size of the medium based on each received signal, and outputs the detection result to the control circuit 271.

The image acquisition circuit 274 is an example of an image acquisition module and has a function similar to the image acquisition module 174. The image acquisition circuit 274 receives an input image from the imaging device 120 and transmits the input image to the information processing device through the interface device 152 or stores the input image into the storage device 160.

As described in detail above, the medium conveying apparatus can suitably control the feeding of the medium, even when using the processing circuit 270.

According to the embodiment, the medium conveying apparatus, the method, and the computer-readable, non-transitory medium storing the control program, can suitably control the feeding of the medium.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a medium tray;

a feed roller to feed by separating a medium placed on the medium tray by separating the medium from a plurality of media;

an upper guide located to face a lower guide to guide the medium to the feed roller;

a movement sensor including an arm provided to be moved by the medium on the upper guide and on an upstream side of the feed roller, to generate a movement amount signal corresponding to a movement amount of the arm;

a medium sensor to detect a presence of the medium at a predetermined position of the medium tray; and a processor to determine that a feeding abnormality of the medium has occurred at a time a movement of the arm is detected from the movement amount signal, detect a size of the medium placed on the medium tray based on a detection result by the medium sensor, and stop feeding of the medium by the feed roller when the processor determines that the feeding abnormality of the medium has occurred and the detected size of the medium is equal to or less than a predetermined size.

2. The medium conveying apparatus according to claim 1, wherein the medium sensor is located in the upper guide and outside the movement sensor in a direction perpendicular to a medium conveying direction, and is a light sensor including a light emitter to irradiate light and a light receiver to generate a signal corresponding to a received light.

3. The medium conveying apparatus according to claim 1, wherein the movement sensor includes an elastic member to press the arm downward.

4. The medium conveying apparatus according to claim 1, wherein the processor returns the medium to the medium tray and controls the feed roller so as to re-feed without separation when the processor stops the feeding of the medium by the feed roller.

5. The medium conveying apparatus according to claim 1, wherein the processor further determines whether the medium is placed on the medium tray, based on the movement amount signal.

6. A method for controlling feeding a medium, comprising:

feeding a medium placed on a medium tray by a feed roller by separating the medium from a plurality of media;

generating a movement amount signal corresponding to a movement amount of an arm provided to be moved by the fed medium on an upper guide located to face a lower guide to guide the medium to the feed roller, and on an upstream side of the feed roller, by a movement sensor;

detecting a presence of the medium at a predetermined position of the medium tray by a medium sensor;

determining that a feeding abnormality of the medium has occurred at a time a movement of the arm is detected, from the movement amount signal;

detecting a size of the medium placed on the medium tray based on a detection result by the medium sensor; and stopping feeding of the medium by the feed roller when it is determined that the feeding abnormality of the medium has occurred and the detected size of the medium is equal to or less than a predetermined size.

7. The method according to claim 6, wherein the medium sensor is located in the upper guide and outside the movement sensor in a direction perpendicular to a medium conveying direction, and is a light sensor including a light emitter to irradiate light and a light receiver to generate a signal corresponding to a received light.

8. The method according to claim 6, wherein the movement sensor includes an elastic member to press the arm downward.

9. The method according to claim 6, further comprising returning the medium to the medium tray, and controlling the feed roller so as to re-feed without separation when the feeding of the medium by the feed roller is stopped.

10. The method according to claim 6, further comprising determining whether the medium is placed on the medium tray, based on the movement amount signal.

11. A computer-readable, non-transitory medium storing a computer program, the computer program, when executed by a processor perform a process comprising:

causing a medium conveying apparatus including a medium tray, a feed roller to feed a medium placed on the medium tray by separating the medium from a plurality of media;

guiding the medium to the feed roller;

moving a movement sensor including an arm by the medium on an upstream side of the feed roller, to generate a movement amount signal corresponding to a movement amount of the arm;

detecting a presence of the medium at a predetermined position of the medium tray;

determining that a feeding abnormality of the medium has occurred at a time a movement of the arm is detected from the movement amount signal;

detecting a size of the medium placed on the medium tray based on a detection result by a medium sensor; and stopping feeding of the medium by the feed roller when it is determined that the feeding abnormality of the medium has occurred and the detected size of the medium is equal to or less than a predetermined size.

12. The computer-readable, non-transitory medium according to claim 11, wherein the medium sensor is located in the upper guide and outside the movement sensor in a direction perpendicular to a medium conveying direction, and is a light sensor including a light emitter to irradiate light and a light receiver to generate a signal corresponding to a received light.

13. The computer-readable, non-transitory medium according to claim 11, wherein the movement sensor includes an elastic member to press the arm downward.

14. The computer-readable, non-transitory medium according to claim 11, the process further comprising returning the medium to the medium tray, and controlling the feed roller so as to re-feed without separation when the feeding of the medium by the feed roller is stopped.

15. The computer-readable, non-transitory medium according to claim 11, the process further comprising determining whether the medium is placed on the medium tray, based on the movement amount signal.

* * * * *